US008815355B2

(12) United States Patent
Tsuchida et al.

(10) Patent No.: US 8,815,355 B2
(45) Date of Patent: Aug. 26, 2014

(54) FIRE EXTINGUISHER, FIRE EXTINGUISHER CYLINDER, AND PREFORM OF FIRE EXTINGUISHER CYLINDER

(75) Inventors: Hideo Tsuchida, Hirakata (JP); Hiroshi Nakayama, Osaka (JP)

(73) Assignee: Hatsuta Seisakusho Co., Ltd., Osaka (JP)

( * ) Notice: Subject to any disclaimer, the term of this patent is extended or adjusted under 35 U.S.C. 154(b) by 476 days.

(21) Appl. No.: 13/124,375

(22) PCT Filed: Jul. 21, 2009

(86) PCT No.: PCT/JP2009/063061

§ 371 (c)(1), (2), (4) Date: May 18, 2011

(87) PCT Pub. No.: WO2010/044298

PCT Pub. Date: Apr. 22, 2010

(65) Prior Publication Data

US 2011/0226496 A1 Sep. 22, 2011

(30) Foreign Application Priority Data

Oct. 16, 2008 (JP) ..... 2008-268022
Oct. 16, 2008 (JP) ..... 2008-268023
Oct. 16, 2008 (JP) ..... 2008-268024

(51) Int. Cl.
*A62C 13/62* (2006.01)
*F17C 1/00* (2006.01)
*F17C 1/16* (2006.01)

(52) U.S. Cl.
CPC .. *A62C 13/62* (2013.01); *F17C 1/16* (2013.01)
USPC ..... 428/35.7; 169/71

(58) Field of Classification Search
CPC ..... A62C 13/00–13/64; A62C 13/76; A62C 11/00; F17C 1/00; F17C 1/16; F17C 1/0754
USPC ..... 428/35.7
See application file for complete search history.

(56) References Cited

U.S. PATENT DOCUMENTS 2,731,093 A * 1/1956 Robert ..... 169/35
2,865,458 A * 12/1958 Manlio et al. ..... 169/35

(Continued)

FOREIGN PATENT DOCUMENTS

JP 56-160560 11/1981
JP 160560/1981 11/1981

(Continued)

OTHER PUBLICATIONS

JP Office Action dated Feb. 5, 2013 for JP Appl. No. 2010-533849.

(Continued)

*Primary Examiner* — Michele L Jacobson
(74) *Attorney, Agent, or Firm* — Dorsey & Whitney LLP

(57) ABSTRACT

Disclosed is a fire extinguisher (100) comprising a fire extinguisher cylinder (10) for a fire-extinguishing agent. The fire extinguisher cylinder (10) comprises a mouth portion as an opening, a shoulder, a cylindrical body portion, and a bottom portion and is shaped with use of a resin provided with no joint. In addition, the body portion in the fire extinguisher cylinder (10) has a thickness from 1 mm to 5 mm, and a crystallinity of the resin is from 13% to 30% at the sites other than the mouth portion and the bottom portion. Accordingly, the fire extinguisher (100) is lightweight and does not rust. Further, the fire extinguisher (100) has high strength or high pressure resistance.

16 Claims, 3 Drawing Sheets

(56) References Cited

U.S. PATENT DOCUMENTS

| | | | | |
|---|---|---|---|---|
| 3,733,309 | A * | 5/1973 | Wyeth et al. | 28/36.92 |
| 3,948,404 | A * | 4/1976 | Collins et al. | 215/372 |
| 4,144,298 | A * | 3/1979 | Lee | 264/532 |
| 4,233,022 | A * | 11/1980 | Brady et al. | 425/525 |
| 4,650,004 | A * | 3/1987 | Wendling et al. | 169/85 |
| 4,854,343 | A * | 8/1989 | Rilett | 137/543.19 |
| 8,336,733 | B2 * | 12/2012 | Laws et al. | 222/5 |
| 2002/0198331 | A1 | 12/2002 | Nishihara et al. | |
| 2004/0166266 | A1 * | 8/2004 | de Wit | 428/35.7 |

FOREIGN PATENT DOCUMENTS

| | | | |
|---|---|---|---|
| JP | 62-145647 | | 9/1987 |
| JP | 2-98536 | A | 4/1990 |
| JP | 2-106317 | A | 4/1990 |
| JP | 2106317 | | 4/1990 |
| JP | 4-142275 | A | 5/1992 |
| JP | 3031761 | | 9/1996 |
| JP | 3031761 | U | 12/1996 |
| JP | 9-313634 | A | 12/1997 |
| JP | 9313634 | | 12/1997 |
| JP | 11-43132 | A | 2/1999 |
| JP | 11-321837 | A | 11/1999 |
| JP | 11321837 | | 11/1999 |
| JP | 2002-67129 | A | 3/2002 |

OTHER PUBLICATIONS

International Search Report (with English translation) for International Application No. PCT/JP2009/063061.

"Japanese Office Action (with English Translation) of JP 200980136318.X dated Mar. 12, 2012".

JP Office Action dated Jun. 11, 2013 for Appl No. 2010-533849.

Office Action for JP Appl No. 2013-077529 dated Oct. 8, 2013.

CN Office Action dated Apr. 25, 2014 for CN Application No. 201210260483.X, 5 pgs.

* cited by examiner

FIRE EXTINGUISHER, FIRE EXTINGUISHER CYLINDER, AND PREFORM OF FIRE EXTINGUISHER CYLINDER

CROSS REFERENCE TO RELATED APPLICATION(S)

This application is a 35 U.S.C. §371 filing of PCT Application No. PCT/JP2009/063061, filed Jul. 21, 2009. This application also claims the benefit of Japanese Application No. 2008-268022, filed Oct. 16, 2008, Japanese Application No. 2008-268023, filed Oct. 16, 2008, and Japanese Application No. 2008-268024, filed Oct. 16, 2008.

TECHNICAL FIELD

The present invention relates to a fire extinguisher, a fire extinguisher cylinder, and a preform of a fire extinguisher cylinder.

BACKGROUND ART

Fire extinguisher cylinders used in fire extinguishers are conventionally made of metals such as iron, a stainless steel, and aluminum. Among these, iron fire extinguisher cylinders are tough and hard to be broken, as well as are manufactured at low cost. Thus, approximately 90% of the fire extinguishers in the market are made of iron these days.

There are also disclosed exemplary fire extinguishers that each include a fire extinguisher cylinder made of a resin. One document discloses a fire extinguisher that allows a fill pressure to be decreased as low as possible so as to be durable even with pressure resistance at a low level, which has been regarded as a weakness of the resin fire extinguisher cylinders (Patent Document 1). Another document discloses a fire extinguisher that is manufactured with use of a waste thin film made of polyethylene terephthalate (PET), which is utilized for soft drink or liquor (Patent Document 2).

PRIOR ART DOCUMENTS

Patent Documents

Patent Document 1: Japanese Unexamined Utility Model Publication No. S56-160560

Patent Document 2: Japanese Unexamined Patent Publication No. H09-313634

SUMMARY OF THE INVENTION

Problems to be Solved by the Invention

Because the iron fire extinguisher cylinders, which are generally used as described above, are quite heavy, there arise problems of inconvenience in portability and poor operability especially for women, children, and elders. Moreover, due to the heavy weights of the metal fire extinguishers, there is caused another problem that the transportation cost is increased upon collecting or recycling the fire extinguishers.

Further, the remaining fire extinguishant in the iron fire extinguisher cylinder cannot be easily checked because the state inside the cylinder is not visually recognized from outside. In general, the residual quantity of a fire extinguishant is checked periodically by qualified personnel. However, normally, because such checkups are not executed so frequently, it should be quite difficult for ordinary people to notice that there is no fire extinguishant left in a fire extinguisher for some reason before the upcoming checkup.

In addition, the iron fire extinguisher is cheap but is corrosive, so that the surface of the cylinder needs to be coated for corrosion control. Such a treatment actually takes time and effort to result in increase in manufacturing cost, which cannot be disregarded relative to a unit price of one fire extinguisher. There is also required to separate a corrosion control agent from iron for recycling the fire extinguisher. Such a process of separating the coated surface also needs quite effort, thereby resulting in remarkable complication in the work of recycling the fire extinguisher cylinders made of metals such as iron as well as in increase in cost therefor.

The above technical problems caused by use of metals such as iron apparently seem to be solved by adoption of resin fire extinguisher cylinders. However, in reality, it is not easy to provide a fire extinguisher cylinder made only of a resin while keeping visibility of the fire extinguishant stored therein and a light weight of the entire cylinder, because a fire extinguisher cylinder is required to be durable for at least several years (eight years, for example) as being required to the generally used metal fire extinguisher cylinders. For example, in a case where one of the resin fire extinguisher cylinders described in Patent Documents 1 and 2 is adopted, there is caused a risk of deformation or bursting of the cylinder by increasing the pressure inside the cylinder to a level (such as approximately 2.0 MPa) substantially equal to the level of pressure resistance guaranteed to a fire extinguisher including a metal cylinder.

Moreover, in the case of forming such a resin fire extinguisher cylinder, it is not easy to increase the thickness of the cylinder so as to satisfy the value of standard or the like applied to the ordinary metal fire extinguishers in Japan.

Solutions to the Problems

The present invention has been devised to solve the above problems in the conventional arts and contributes largely to realization of a fire extinguisher with a light weight and pressure resistance at a high level.

The inventors were intensively involved in development of a resin fire extinguisher cylinder that can replace a currently used metal fire extinguisher cylinder in various ways. The inventors finally succeeded in achieving a configuration of a fire extinguisher cylinder that can solve the respective technical problems described above.

A fire extinguisher according to the present invention includes a fire extinguisher cylinder. The fire extinguisher cylinder has an opened mouth portion, a shoulder portion, a cylindrical body portion, and a bottom portion, and is shaped with use of a resin provided with no joint. The body portion has a thickness from 1 mm to 5 mm, and a crystallinity of the resin is from 13% to 30% at the sites other than the mouth portion and the bottom portion.

In this fire extinguisher, the fire extinguisher cylinder is made of a resin to achieve reduction in weight and cause no corrosion. More specifically, the entire fire extinguisher can be reduced in weight to approximately 70% of a conventional iron fire extinguisher. Further, because the crystallinity of the resin of the cylinder is from 13% to 30%, strength and pressure resistance of the fire extinguisher cylinder are improved by the crystallization of the resin, although the detailed mechanism has not yet been found out. In view of the realization of such sufficient pressure resistance and strength, there will be little necessity for the achievement of a resin crystallinity exceeding 30%. Accordingly, adoption of the above configuration improves strength and pressure resistance of the cylinder to the levels equivalent to those of the conventional fire extinguisher and exerts the advantageous effects of the resin fire extinguisher cylinder. Moreover, this fire extinguisher cylinder is provided with no joint and includes the body portion of a thickness from 1 mm to 5 mm, thereby also realizing the fire extinguisher including the fire extinguisher cylinder with a light weight and strength at a high level.

Another fire extinguisher according to the present invention includes a fire extinguisher cylinder. The fire extinguisher cylinder is made of a resin by stretch blow molding, and has an opened mouth portion, a shoulder portion, a cylindrical body portion, and a bottom portion. Further, the body portion has a stretch factor in a circumferential direction being from 1.05 to 1.4 times a stretch factor at the body portion in a direction perpendicular to the circumferential direction.

This fire extinguisher cylinder achieves reduction in weight and causes no corrosion. More specifically, the fire extinguisher cylinder can be reduced in weight to approximately 33% of a conventional iron fire extinguisher cylinder. Further, the body portion has the stretch factor in the circumferential direction being from 1.05 to 1.4 times the stretch factor in the direction perpendicular to the circumferential direction, so that the fire extinguisher includes the fire extinguisher cylinder with pressure resistance at a high level. In the present application, the "direction perpendicular to the circumferential direction" indicates the vertical direction that is different from the thickness direction of the body portion of the above fire extinguisher cylinder. In other words, the "direction perpendicular to the circumferential direction" generally indicates the vertical direction along which the fire extinguisher stands. Hereinafter, the similar description will not be repeated.

Still another fire extinguisher according to the present invention includes a fire extinguisher cylinder. The fire extinguisher cylinder has an opened mouth portion, a shoulder portion, a cylindrical body portion, and a bottom portion. Further, the fire extinguisher cylinder is shaped with use of a resin provided with no joint and having a whole light transmittance from 5% to 75%, and the body portion has a thickness from 1 mm to 5 mm.

In this fire extinguisher, the fire extinguisher cylinder is made of a resin to achieve reduction in weight and cause no corrosion. More specifically, the entire fire extinguisher can be reduced in weight to approximately 70% of a conventional iron fire extinguisher. Focusing only on the resin fire extinguisher cylinder, the weight thereof is approximately 33% of that of a conventional iron fire extinguisher cylinder. Further, because the resin has a whole light transmittance from 5% to 75%, it is possible to easily check the remaining fire extinguishant. More specifically, because the cylinder is formed to have a whole light transmittance of 75% or less, there is exerted a significant advantage in the actual application to the society that the contents in the cylinder is not visually recognized too clearly. In a case where the whole light transmittance is too high, the fire extinguishant contained in the cylinder and adhering to the wall surface of the cylinder may be externally recognized as dirt on the fire extinguisher, thereby causing deterioration in visual quality of the place therearound. On the other hand, in a case where the whole light transmittance is less than 5%, the residual quantity of the fire extinguishant is hard to be checked in emergency. Thus, harmonization between utility and visual quality of the outer appearance is achieved by keeping appropriate transparency. Moreover, this fire extinguisher cylinder is provided with no joint and has a thickness from 1 mm to 5 mm. The cylinder formed to have such a thickness realizes strength at a high level. Therefore, there is obtained the fire extinguisher including the fire extinguisher cylinder that has strength at a high level while keeping appropriate transparency.

A fire extinguisher cylinder according to the present invention has an opened mouth portion, a shoulder portion, a cylindrical body portion, and a bottom portion, and is molded with use of a resin provided with no joint. The body portion has a thickness from 1 mm to 5 mm, and the resin has a crystallinity from 13% to 30% at the sites other than the mouth portion and the bottom portion.

This fire extinguisher cylinder is made of a resin to achieve reduction in weight and cause no corrosion. More specifically, the fire extinguisher cylinder can be reduced in weight to approximately 70% of a conventional iron fire extinguisher cylinder. Focusing only on the resin fire extinguisher cylinder, the weight thereof is approximately 33% of that of the conventional iron fire extinguisher cylinder. Further, because the crystallinity of the resin of the cylinder is from 13% to 30%, strength and pressure resistance of the fire extinguisher cylinder are improved by the crystallization of the resin, although the detailed mechanism has not yet been found out. In view of the realization of such sufficient pressure resistance and strength, there will be little necessity for the achievement of a resin crystallinity exceeding 30%. Accordingly, adoption of the above configuration improves strength and pressure resistance of the cylinder to the levels equivalent to the levels of that of the conventional fire extinguisher and exerts the advantageous effects of the resin fire extinguisher cylinder. Moreover, this fire extinguisher cylinder is provided with no joint and includes the body portion of a thickness from 1 mm to 5 mm, thereby realizing strength at a high level of the fire extinguisher cylinder.

Another fire extinguisher cylinder according to the present invention is made of a resin by stretch blow molding, and has an opened mouth portion, a shoulder portion, a cylindrical body portion, and a bottom portion. Further, the body portion has a stretch factor in a circumferential direction being from 1.05 to 1.4 times a stretch factor at the body portion in a direction perpendicular to the circumferential direction.

This fire extinguisher cylinder achieves reduction in weight and causes no corrosion. More specifically, the fire extinguisher cylinder can be reduced in weight to approximately 33% of a conventional iron fire extinguisher cylinder. Further, the body portion has the stretch factor in the circumferential direction being from 1.05 to 1.4 times the stretch factor in the direction perpendicular to the circumferential direction, so that there is obtained the fire extinguisher cylinder having pressure resistance at a high level.

A preform of a fire extinguisher cylinder according to the present invention is molded with use of a resin that is provided with no joint and has a whole light transmittance from 5% to 75%, and the preform has a thickness from 4 mm to 30 mm.

The preform of this fire extinguisher cylinder is used in stretch blow molding. Because the resin of the preform of this fire extinguisher cylinder has a whole light transmittance from 5% to 75%, the cylinder having been processed by stretch blow molding still achieves appropriate transparency by the harmonization between utility and visual quality of the outer appearance. In addition, the preform is made of a resin that is provided with no joint and has a thickness from 4 mm to 30 mm. Therefore, the fire extinguisher cylinder having been processed by stretch blow molding still has a thickness from 1 mm to 5 mm with no joint provided therein, and has strength at a high level, which is suitable for practical use.

Effects of the Invention

A fire extinguisher according to the present invention achieves reduction in weight and causes no corrosion. Further, this fire extinguisher can realize strength and pressure resistance at high levels, respectively. Another fire extinguisher according to the present invention realizes strength at a high level while keeping appropriate transparency, thereby achieving harmonization between utility and visual quality of the outer appearance.

A preform of a fire extinguisher cylinder according to the present invention achieves, even after having been processed by stretch blow molding, appropriate transparency by harmonization between utility and visual quality of the outer appearance as well as strength at a high level.

MODES FOR CARRYING OUT THE INVENTION

Figure 1:
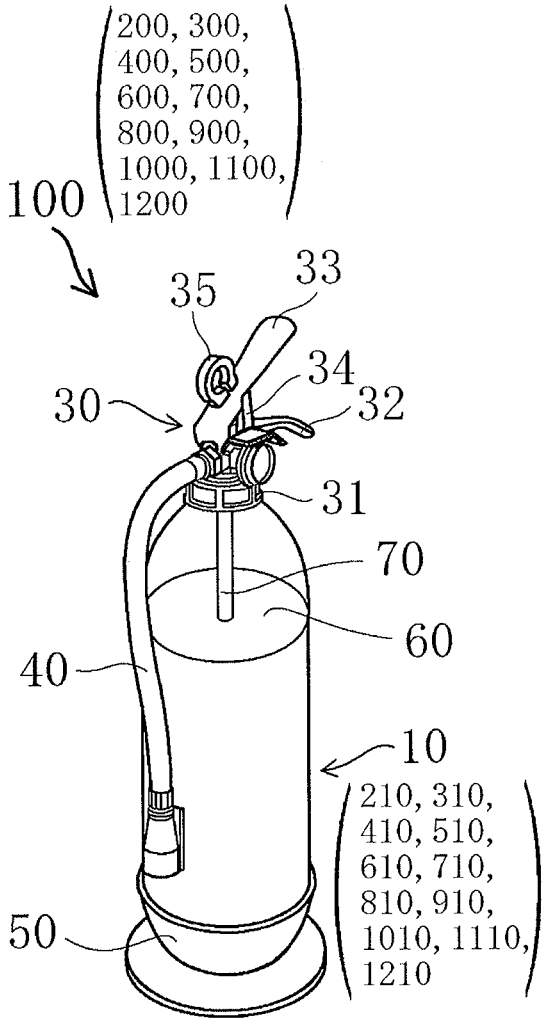
FIG. 1 is an external view showing an entire fire extinguisher according to an embodiment of the present invention.

Embodiments of the present invention will be described in detail with reference to the accompanying drawings. In this description, common parts are denoted by common reference symbols in all the drawings unless otherwise specified. Further, elements in these embodiments are not necessarily illustrated according to the same scale in the drawings. Some of the symbols may not be indicated in the drawings for the purpose of simplification in appearance thereof.

First Embodiment

Figure 2:
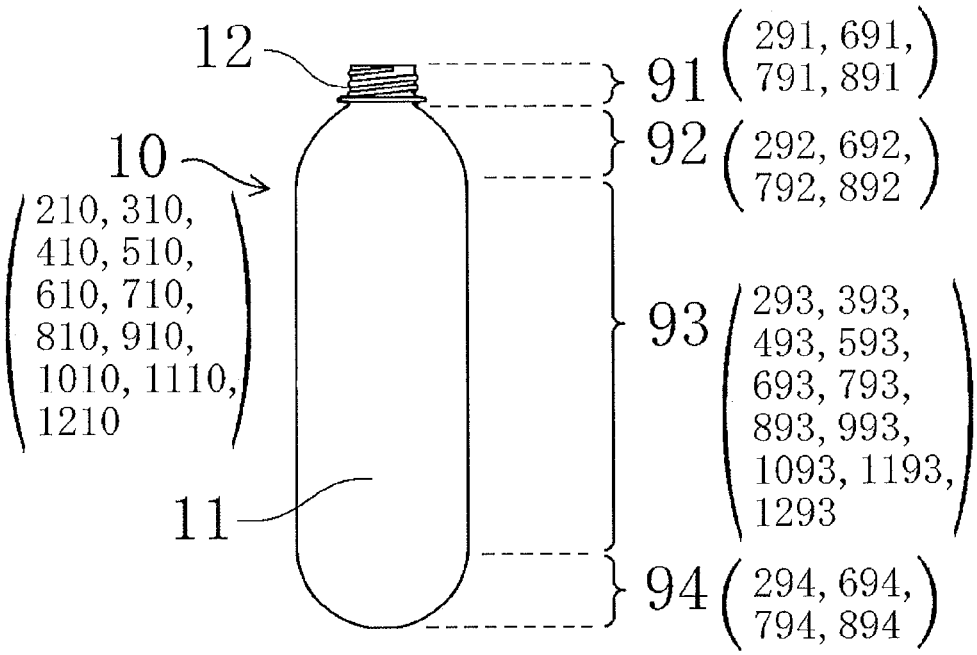
FIG. 2 is a front view of a fire extinguisher cylinder according to an embodiment of the present invention.
Figure 3:
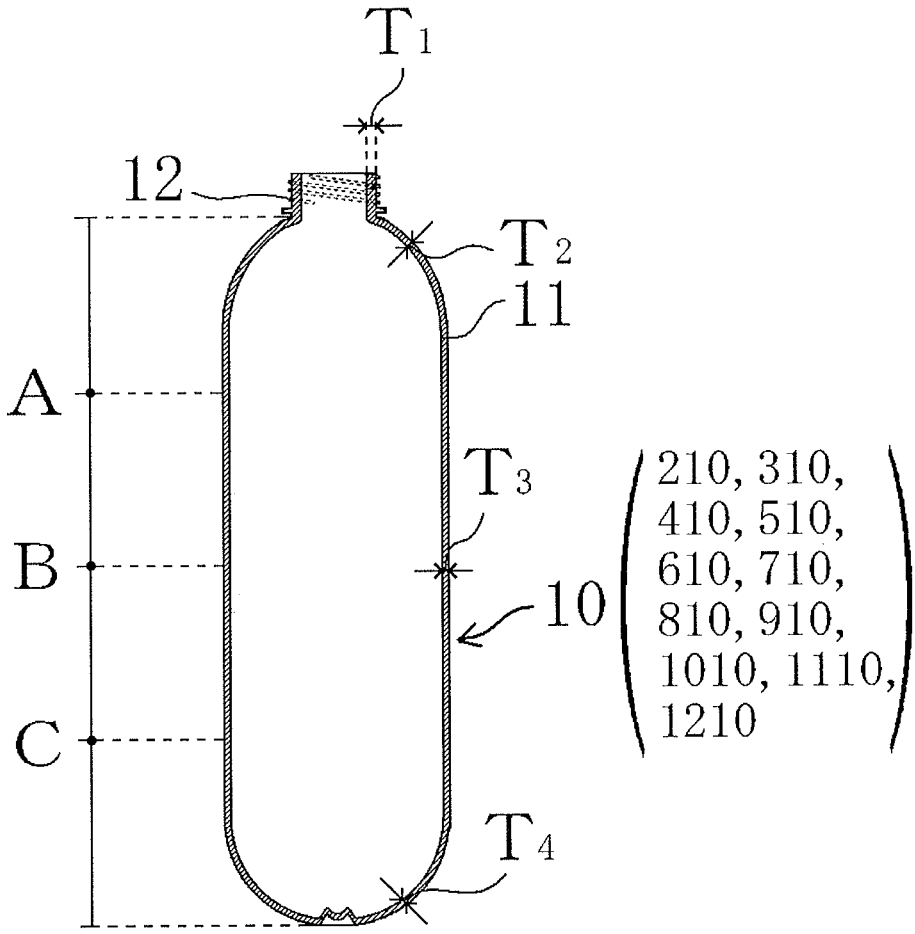
FIG. 3 is a front cross-sectional view of a fire extinguisher cylinder according to an embodiment of the present invention.

FIG. 1 is an external view of an entire fire extinguisher 100 according to the present embodiment. FIG. 2 is a front view of a fire extinguisher cylinder 10, and FIG. 3 is a front cross-sectional view of the fire extinguisher cylinder 10. In FIG. 2, there are drawn dashed lines and solid lines for convenience in illustration of portions of the fire extinguisher cylinder 10. Further, in FIG. 3, drawn for convenience are arrows indicating the thickness of the fire extinguisher cylinder 10 and dashed lines extending the cross-sectional shape of a mouth portion 91 for indication of the thickness of the mouth portion 91. Moreover, in FIG. 3, when the height of the fire extinguisher cylinder 10 from the top end to the bottom end without including the mouth portion 91 is divided equally into four parts, a point A is located at a position shifted downward from the top end of the fire extinguisher cylinder 10 by ¼ of the height, a point B is located at a position shifted downward from the top end of the fire extinguisher cylinder 10 by ½ of the height, and a point C is located at a position shifted downward from the top end of the fire extinguisher cylinder 10 by ¾ of the height. The above points A to C each indicate a part of a body portion 93.

As shown in FIG. 1, the fire extinguisher 100 according to the present embodiment includes the fire extinguisher cylinder 10 filled with a fire extinguishant 60 (such as a powdery fire extinguishant), a support base 50 fitted with a bottom portion 94 of the fire extinguisher cylinder 10 to hold the fire extinguishant 60, a fire extinguisher lever handle 30 provided above the fire extinguisher cylinder 10, a siphon tube 70 for guiding the fire extinguishant 60 stored in the fire extinguisher cylinder 10 to the fire extinguisher lever handle 30, and a fire extinguisher hose 40 to be communicably connected with the siphon tube 70 when the fire extinguisher lever handle 30 is operated.

The fire extinguisher lever handle 30 is provided with a cap 31, a carry handle 32, a top lever 33, a safety pin socket 34, and a safety pin 35. In the present embodiment, the safety pin 35 is engaged with the safety pin socket 34 to fix the top lever 33 unrotatably with respect to the carry handle 32. When the safety pin 35 is disengaged from the safety pin socket 34, the top lever 33 is made rotatable with respect to the carry handle 32.

Moreover, the fire extinguisher cylinder 10 according to the present embodiment is configured by a fire extinguisher storage portion 11 and a male thread portion 12 that is provided around an opening located at an upper portion of the fire extinguisher storage portion 11. When the fire extinguisher lever handle 30 is threadably mounted on the male thread portion 12, the fire extinguisher cylinder 10 and the fire extinguisher lever handle 30 are fixed to each other. The fixing manner between the fire extinguisher cylinder 10 and the fire extinguisher lever handle 30 is not limited to the threadable mounting, but it is possible to alternatively adopt any other known joining manner.

The fire extinguisher 100 according to the present embodiment includes the fire extinguisher cylinder 10 made of polyethylene naphthalate (PEN). In the fire extinguisher cylinder 10 of the present embodiment, the mouth portion 91 has a thickness (T1) from 2 mm to 5 mm, and a curved shoulder portion 92 has a thickness (T2) from 1.2 mm to 12 mm. The cylindrical body portion 93 has a thickness (T3) from 1.3 mm to 1.7 mm, and the curved bottom portion 94 has a thickness (T4) from 1.2 mm to 12 mm. The fire extinguisher cylinder 10 according to the present embodiment has a whole light transmittance of approximately 50%. The fire extinguisher cylinder 10 of the present embodiment is made only of polyethylene naphthalate (PEN) if disregarding impurities mixed during the manufacturing process. As shown in FIGS. 1 to 3, the fire extinguisher cylinder 10 of the present embodiment has no joint, which is formed in a metal fire extinguisher cylinder.

There were made measurements of crystallinities of the resin at the respective portions of the fire extinguisher cylinder 10 according to the present embodiment. In the present embodiment, the crystallinities of the resin were each calculated on the basis of the measurement of an energy (J/g) required for transition in accordance with JIS (Japanese Industrial Standards) K 7122 (Testing Methods for Heat of Transitions of Plastics).

By the measurements, the crystallinity of the resin at the mouth portion 91 was found to be substantially 0%, and the crystallinity of the resin at the shoulder portion 92 was from 13% to 23%. Further, the crystallinity of the resin at the body portion 93 was from 14% to 27%, and the crystallinity of the resin at the bottom portion 94 was from 10% to 20%.

As described above, because the crystallinity of the resin at the body portion 93 is from 13% to 30% in the fire extinguisher cylinder 10, strength and pressure resistance of the fire extinguisher cylinder are improved by the crystallization of the resin, although the detailed mechanism has not yet been found out. Increase in crystallinity of the resin improves strength and/or pressure resistance of the cylinder 10, so that the cylinder can achieve excellent durability required to the fire extinguisher 100 even though the cylinder is relatively thin. For example, the resin at the body portion 93 of the fire extinguisher cylinder 10 according to the present embodiment has a crystallinity of 14% or more, which provides strength and/or pressure resistance sufficient for a fire extinguisher. It is noted that, because such sufficient pressure resistance and strength have been already secured at this stage, there will be little necessity for the achievement of a crystallinity exceeding 30% for the resin at the body portion 93.

In the fire extinguisher cylinder 10 according to the present embodiment, the thickness (T3) of the body portion 93 is preferably from 1 mm to 5 mm. If the thickness of the resin is less than 1 mm, it may not be possible to achieve strength at a level (such as approximately 2.0 MPa) required to a fire extinguisher cylinder. On the other hand, if the thickness thereof is more than 5 mm, such a cylinder is not economically preferable and may not be possible to achieve transparency enough to visually recognize the fire extinguishant contained therein. In view of the above, the thickness (T3) of the body portion 93 is more preferably from 1 mm to 3 mm.

The fire extinguisher cylinder 10 according to the present embodiment, which is made of polyethylene naphthalate (PEN), can be manufactured by adopting one of the conventionally known resin molding methods such as stretch blow molding and melting molding. Among these, stretch blow molding is preferably adopted because the resultant cylinder is provided with no joint, is well shaped, and has an appropriate thickness.

Described next is a method for manufacturing by stretch blow molding the fire extinguisher cylinder 10 according to the present embodiment.

Firstly, polyethylene naphthalate (PEN) as a material for the fire extinguisher cylinder 10 is melted and this resin is injected or extruded into an injection molding die to obtain a preformed article (hereinafter, referred to as preform) having a thickness of approximately 15 mm and a whole light transmittance of approximately 5%. The preform is then stretched so as to obtain a product more than 12 by multiplying a stretch factor in scalar quantity at the body portion 93 in the circumferential direction by a stretch factor in scalar quantity in the direction perpendicular to the circumferential direction. In this manner, the fire extinguisher cylinder 10 is formed to have a side surface of a thickness from 1 mm to 5 mm.

As described above, in the case where the fire extinguisher cylinder 10 is shaped by stretch blow molding, strength or pressure resistance is enhanced and the resin has a crystallinity enough to achieve appropriate transparency. In the case of adopting stretch blow molding, there are inevitably provided sites of a low resin crystallinity in the mouth portion 91, partially in the shoulder portion 92, and partially in the bottom portion 94. The cylinder is therefore prepared to be thicker at these sites in comparison to the other sites in order to secure strength or pressure resistance required to a fire extinguisher.

In particular, the thickness (T3) of the body portion 93 is preferably made from 1 mm to 5 mm in order to secure enough pressure resistance of the fire extinguisher cylinder 10 as a final molded component. Accordingly, the preform of the fire extinguisher cylinder 10 in the present embodiment preferably has a thickness from 4 mm to 30 mm. Moreover, preferably obtained is a product of 12 or more by multiplying the stretch factor in scalar quantity at the body portion 93 in the circumferential direction by the stretch factor in scalar quantity in the direction perpendicular to the circumferential direction.

Second Embodiment

A fire extinguisher 200 according to the present embodiment has a configuration same as that of the first embodiment except a feature that a fire extinguisher cylinder 210 is made of polyethylene terephthalate (PET) as well as except the thickness of the preform during the manufacturing process and the stretch blow factors. Accordingly, there will not be repeatedly provided the description same as that of the first embodiment.

The fire extinguisher 200 according to the present embodiment includes the fire extinguisher cylinder 210 made of polyethylene terephthalate (PET). In the fire extinguisher cylinder 210 of the present embodiment, a mouth portion 291 has a thickness (T1) from 2 mm to 5 mm, and a shoulder portion 292 has a thickness (T2) from 2 mm to 12 mm. Further, a body portion 293 has a thickness (T3) from 2 mm to 3 mm, and a bottom portion 294 has a thickness (T4) from 2 mm to 12 mm. The fire extinguisher cylinder 210 according to the present embodiment has a whole light transmittance of approximately 50%. The fire extinguisher cylinder 210 of the present embodiment is made only of polyethylene terephthalate (PET) if disregarding impurities mixed during the manufacturing process. As shown in FIGS. 1 to 3, the fire extinguisher cylinder 210 of the present embodiment has no joint, which is formed in a metal fire extinguisher cylinder.

There were made measurements of crystallinities of the resin at the respective portions of the fire extinguisher cylinder 210 according to the present embodiment by adopting the measurement method similar to that of the first embodiment. The crystallinities of the resin at the mouth portion 291, the shoulder portion 292, the body portion 293, and the bottom portion 294 were respectively in the numerical ranges equivalent to those of the first embodiment.

In the fire extinguisher cylinder 210 according to the present embodiment, the thickness (T3) of the body portion 293 is preferably from 1 mm to 5 mm as well, for a reason similar to that of the first embodiment. In view of the above, the thickness (T3) of the body portion 293 is more preferably from 2 mm to 3 mm.

Also in the present embodiment, polyethylene terephthalate (PET) as the material for the fire extinguisher cylinder 210 is firstly melted and this resin is injected or extruded into an injection molding die to obtain a preform having a thickness of approximately 10 mm and a whole light transmittance of approximately 5%. The preform is then stretched so as to obtain a product more than 6 by multiplying a stretch factor in scalar quantity at the body portion 293 in the circumferential direction by a stretch factor in scalar quantity in the direction perpendicular to the circumferential direction. In this manner, the fire extinguisher cylinder 210 is formed to have the body portion 293 of the thickness (T3) from 2 mm to 3 mm. It is noted that the preform of the fire extinguisher cylinder 210 in the present embodiment preferably has a thickness from 5 mm to 15 mm.

Third Embodiment

A fire extinguisher 300 according to the present embodiment has a configuration same as that of the fire extinguisher 100 according to the first embodiment except a feature that a fire extinguisher cylinder 310 is included in place of the fire extinguisher cylinder 10 of the first embodiment. Accordingly, there will not be repeatedly provided the description same as that of the first embodiment.

The fire extinguisher cylinder 310 of the present embodiment is made only of polyethylene naphthalate (PEN) if disregarding impurities mixed during the manufacturing process. Because the fire extinguisher cylinder 310 is manufactured by stretch blow molding, the resultant cylinder is provided with no joint, is well shaped, and has an appropriate thickness. Further, because the stretch blow molding method includes a stretching step, polymer chains of the resin are oriented substantially in one direction. Improved therefore are transparency, strength, and rigidity of the resin.

The fire extinguisher cylinder 310 according to the present embodiment is preferably shaped to have a body portion 393 of a thickness (T3) of 1.8 mm±0.4 mm. The fire extinguisher cylinder 310 of such a thickness can realize pressure resistance at a level (such as approximately 2.0 MPa) required to a fire extinguisher cylinder, economic efficiency, and appropriate visibility for visual recognition of the contained fire extinguishant.

Described next is a method for manufacturing the fire extinguisher cylinder 310 according to the present embodiment. In the present embodiment, polyethylene naphthalate (PEN) as a material for the fire extinguisher cylinder 310 is firstly melted and this resin is injected or extruded into an injection molding die to obtain a preform having a thickness of approximately 15 mm±0.4 mm and a whole light transmittance of approximately 5%. The preform is then shaped into a final molded component so as to have a stretch factor at the body portion 393 in the circumferential direction being from 1.05 to 1.4 times a stretch factor thereat in the direction perpendicular to the circumferential direction, as well as to obtain a product from 12 to 13 by multiplying the stretch factor in the circumferential direction by the stretch factor in the direction perpendicular to the circumferential direction. These stretch factors secure pressure resistance required to a fire extinguisher cylinder.

With the fire extinguisher cylinder 310 as a representative example, described next is how pressure resistance is improved in the case where the body portion 393 of the fire extinguisher cylinder 310 according to the present embodiment is formed to have the stretch factor in the circumferential direction being from 1.05 to 1.4 times the stretch factor in the direction perpendicular to the circumferential direction, as well as to obtain a product from 12 to 13 by multiplying the stretch factor in scalar quantity in the circumferential direction by the stretch factor in scalar quantity in the direction perpendicular to the circumferential direction.

Tables 1 to 6 indicate measurement results of permanent strain rates when an inner portion of the fire extinguisher cylinder 310 is uniformly pressurized. In the present embodiment, the measurements of the permanent strain rates were performed before and after applying pressures of 1 MPa, 1.6 MPa, 2.0 MPa, 2.4 MPa, and 3.0 MPa, respectively. More specifically, the permanent strain rates of the body portion 393 in the circumferential direction as well as in the direction perpendicular to the circumferential direction were measured at the points A, B, and C indicated in FIG. 3 before and after applying the above pressures, respectively. There was adopted a nitrogen gas tank as a pressure source, and the measurements were made with use of a pressure regulator (model YR-5062) manufactured by YAMATOSANGYO CO., LTD. and a pressure gauge (model S41 or GLT41) manufactured by MIGISHITA SEIKI MFG. CO., LTD.

Table 1 indicates results of tests performed on the fire extinguisher cylinder 210, of which preform has a thickness of 15 mm±0.4 mm at the site corresponding to the body portion 393 of the final molded component, of which stretch factor at the body portion 393 in the circumferential direction is 3.5, and of which stretch factor thereat in the direction perpendicular to the circumferential direction is 3.5. In other words, at the body portion 393 of the fire extinguisher cylinder 210, the proportion of the stretch factor (3.5) in the direction perpendicular to the circumferential direction to the stretch factor (3.5) in the circumferential direction is 1:1. Further, when the stretch factors are respectively considered in scalar quantity, a product of 12.25 is obtained by multiplying the stretch factor in scalar quantity in the circumferential direction by the stretch factor in scalar quantity in the direction perpendicular to the circumferential direction.

Table 2 indicates results of tests performed on the fire extinguisher cylinder 310, of which preform has a thickness of 15 mm±0.4 mm at the site corresponding to the body portion 393 of the final molded component, of which stretch factor at the body portion 393 in the circumferential direction is 3.6, and of which stretch factor thereat in the direction perpendicular to the circumferential direction is 3.4. In other words, at the body portion 393 of the fire extinguisher cylinder 310, the proportion of the stretch factor (3.4) in the direction perpendicular to the circumferential direction to the stretch factor (3.6) in the circumferential direction is 1:1.06. Further, when the stretch factors are respectively considered in scalar quantity, a product of 12.24 is obtained by multiplying the stretch factor in scalar quantity in the circumferential direction by the stretch factor in scalar quantity in the direction perpendicular to the circumferential direction.

Table 3 indicates results of tests performed on the fire extinguisher cylinder 310, of which preform has a thickness of 15 mm±0.4 mm at the site corresponding to the body portion 393 of the final molded component, of which stretch factor at the body portion 393 in the circumferential direction is 3.7, and of which stretch factor thereat in the direction perpendicular to the circumferential direction is 3.3. In other words, at the body portion 393 of the fire extinguisher cylinder 310, the proportion of the stretch factor (3.3) in the direction perpendicular to the circumferential direction to the stretch factor (3.7) in the circumferential direction is 1:1.12. Further, when the stretch factors are respectively considered in scalar quantity, a product of 12.21 is obtained by multiplying the stretch factor in scalar quantity in the circumferential direction by the stretch factor in scalar quantity in the direction perpendicular to the circumferential direction.

Table 4 indicates results of tests performed on the fire extinguisher cylinder 310, of which preform has a thickness of 15 mm±0.4 mm at the site corresponding to the body portion 393 of the final molded component, of which stretch factor at the body portion 393 in the circumferential direction is 3.8, and of which stretch factor thereat in the direction perpendicular to the circumferential direction is 3.2. In other words, at the body portion 393 of the fire extinguisher cylinder 310, the proportion of the stretch factor (3.2) in the direction perpendicular to the circumferential direction to the stretch factor (3.8) in the circumferential direction is 1:1.19. Further, when the stretch factors are respectively considered in scalar quantity, a product of 12.16 is obtained by multiplying the stretch factor in scalar quantity in the circumferential direction by the stretch factor in scalar quantity in the direction perpendicular to the circumferential direction.

Table 5 indicates results of tests performed on the fire extinguisher cylinder 310, of which preform has a thickness of 15 mm±0.4 mm at the site corresponding to the body portion 393 of the final molded component, of which stretch factor at the body portion 393 in the circumferential direction is 3.9, and of which stretch factor thereat in the direction perpendicular to the circumferential direction is 3.1. In other words, at the body portion 393 of the fire extinguisher cylinder 310, the proportion of the stretch factor (3.1) in the direction perpendicular to the circumferential direction to the stretch factor (3.9) in the circumferential direction is 1:1.26. Further, when the stretch factors are respectively considered in scalar quantity, a product of 12.09 is obtained by multiplying the stretch factor in scalar quantity in the circumferential direction by the stretch factor in scalar quantity in the direction perpendicular to the circumferential direction.

Table 6 indicates results of tests performed on the fire extinguisher cylinder 310, of which preform has a thickness of 15 mm±0.4 mm at the site corresponding to the body portion 393 of the final molded component, of which stretch factor at the body portion 393 in the circumferential direction is 4.0, and of which stretch factor thereat in the direction perpendicular to the circumferential direction is 3.0. In other words, at the body portion 393 of the fire extinguisher cylinder 310, the proportion of the stretch factor (3.0) in the direction perpendicular to the circumferential direction to the stretch factor (4.0) in the circumferential direction is 1:1.33. Further, when the stretch factors are respectively considered in scalar quantity, a product of 12 is obtained by multiplying the stretch factor in scalar quantity in the circumferential direction by the stretch factor in scalar quantity in the direction perpendicular to the circumferential direction.

Table 7 indicates results of tests performed on the fire extinguisher cylinder 310, of which preform has a thickness of 15 mm±0.4 mm at the site corresponding to the body portion 393 of the final molded component, of which stretch factor at the body portion 393 in the circumferential direction is 4.1, and of which stretch factor thereat in the direction perpendicular to the circumferential direction is 2.9. In other words, at the body portion 393 of the fire extinguisher cylinder 310, the proportion of the stretch factor (2.9) in the direction perpendicular to the circumferential direction to the stretch factor (4.1) in the circumferential direction is 1:1.41. Further, when the stretch factors are respectively considered in scalar quantity, a product of 11.89 is obtained by multiplying the stretch factor in scalar quantity in the circumferential direction by the stretch factor in scalar quantity in the direction perpendicular to the circumferential direction.

TABLE 1

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.15 | 0.00 | 0.15 | 0.00 | 0.15 |
| 2.0 | 0.15 | 0.00 | 0.15 | 0.00 | 0.15 |
| 2.4 | 0.45 | 0.30 | 0.45 | 0.00 | 0.45 |
| 3.0 | 0.98 | 0.76 | 0.76 | 0.00 | 0.98 |

Third embodiment
Stretch factor in circumferential direction: 3.5
Stretch factor in direction perpendicular to circumferential direction: 3.5

TABLE 2

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.14 | 0.00 | 0.14 | 0.00 | 0.14 |
| 2.0 | 0.14 | 0.00 | 0.14 | 0.00 | 0.14 |
| 2.4 | 0.41 | 0.28 | 0.41 | 0.00 | 0.41 |
| 3.0 | 0.89 | 0.69 | 0.69 | 0.00 | 0.89 |

Third embodiment
Stretch factor in circumferential direction: 3.6
Stretch factor in direction perpendicular to circumferential direction: 3.4

TABLE 3

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.12 | 0.00 | 0.13 | 0.00 | 0.13 |
| 2.0 | 0.12 | 0.00 | 0.13 | 0.00 | 0.13 |
| 2.4 | 0.37 | 0.25 | 0.38 | 0.02 | 0.35 |
| 3.0 | 0.79 | 0.63 | 0.63 | 0.10 | 0.69 |

Third embodiment
Stretch factor in circumferential direction: 3.7
Stretch factor in direction perpendicular to circumferential direction: 3.3

TABLE 4

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.10 | 0.00 | 0.11 | 0.00 | 0.11 |
| 2.0 | 0.10 | 0.00 | 0.11 | 0.10 | 0.11 |
| 2.4 | 0.30 | 0.23 | 0.34 | 0.19 | 0.15 |
| 3.0 | 0.65 | 0.56 | 0.56 | 0.49 | 0.16 |

Third embodiment
Stretch factor in circumferential direction: 3.8
Stretch factor in direction perpendicular to circumferential direction: 3.2

TABLE 5

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.08 | 0.00 | 0.10 | 0.00 | 0.00 |
| 2.0 | 0.08 | 0.00 | 0.10 | 0.19 | 0.19 |
| 2.4 | 0.24 | 0.20 | 0.30 | 0.38 | 0.38 |
| 3.0 | 0.52 | 0.51 | 0.51 | 0.79 | 0.28 |

Third embodiment
Stretch factor in circumferential direction: 3.9
Stretch factor in direction perpendicular to circumferential direction: 3.1

TABLE 6

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.06 | 0.00 | 0.09 | 0.01 | 0.09 |
| 2.0 | 0.06 | 0.00 | 0.09 | 0.19 | 0.19 |
| 2.4 | 0.19 | 0.18 | 0.27 | 0.57 | 0.39 |
| 3.0 | 0.42 | 0.46 | 0.46 | 0.88 | 0.46 |

Third embodiment
Stretch factor in circumferential direction: 4.0
Stretch factor in direction perpendicular to circumferential direction: 3.0

TABLE 7

| Pressure (MPa) | Permanent Strain Rates (%) Circumferential Direction A | B | C | Direction Perpendicular to Circumferential Direction | Maximum Difference among Permanent Strain Rates |
|---|---|---|---|---|---|
| 1.0 | 0.00 | 0.00 | 0.00 | 0.00 | 0.00 |
| 1.6 | 0.05 | 0.00 | 0.07 | 0.01 | 0.07 |
| 2.0 | 0.05 | 0.00 | 0.09 | 0.23 | 0.23 |
| 2.4 | 0.15 | 0.14 | 0.21 | 0.68 | 0.47 |
| 3.0 | 0.31 | 0.35 | 0.35 | 1.01 | 0.70 |

Third embodiment
Stretch factor in circumferential direction: 4.1
Stretch factor in direction perpendicular to circumferential direction: 2.9

In the fire extinguisher cylinder 310 of Table 1, even after the application of a pressure from 1.0 MPa to 2.0 MPa, the permanent strain rates in the circumferential direction are 0.15% or less at the point A, 0% at the point B, and 0.15% or less at the point C, respectively, and the permanent strain rate in the direction perpendicular to the circumferential direction is 0% with the application of any pressure within the above range. After the application of the pressure of 2.4 MPa, the permanent strain rates in the circumferential direction are 0.45% at the point A, 0.30% at the point B, and 0.45% at the point C, respectively, and the permanent strain rate in the direction perpendicular to the circumferential direction is 0%. However, in the case where the pressure of 3.0 MPa is applied, the permanent strain rate in the circumferential direction is as large as 0.98% at the point A, which is less than 1%. In this case, the permanent strain rates in the circumferential direction are 0.76% at the point B and the point C, and the permanent strain rate in the direction perpendicular to the circumferential direction remains 0%. Thus, with any one of the above pressures being applied, the permanent strain rates in the circumferential direction as well as the permanent strain rate in the direction perpendicular to the circumferential direction are kept to be less than 1%, respectively. It is therefore recognized that the fire extinguisher cylinder 310 of Table 1 exerts sufficient pressure resistance required to a fire extinguisher cylinder.

In the fire extinguisher cylinder 310 of Table 2, even after the application of a pressure from 1.0 MPa to 2.0 MPa, the permanent strain rates in the circumferential direction are 0.14% or less at the point A, 0% at the point B, and 0.14% or less at the point C, respectively, and the permanent strain rate in the direction perpendicular to the circumferential direction is 0% with the application of any pressure within the above range. After the application of the pressure of 2.4 MPa, the permanent strain rates in the circumferential direction are 0.41% at the point A, 0.28% at the point B, and 0.41% at the point C, respectively, and the permanent strain rate in the direction perpendicular to the circumferential direction is 0%. In the case where the pressure of 3.0 MPa is applied, the permanent strain rates in the circumferential direction are as small as 0.89% at the point A and 0.69% at the point B and the point C, and the permanent strain rate in the direction perpendicular to the circumferential direction remains 0%. Thus, with any one of the above pressures being applied, the permanent strain rates in the circumferential direction as well as the permanent strain rate in the direction perpendicular to the circumferential direction are less than 1% and are kept to be at most 0.9%, respectively. It is therefore recognized that the fire extinguisher cylinder 310 of Table 2 exerts sufficient pressure resistance required to a fire extinguisher cylinder.

In the fire extinguisher cylinder 310 of Table 3, even after the application of a pressure from 1.0 MPa to 2.0 MPa, the permanent strain rates in the circumferential direction are 0.12% or less at the point A, 0% at the point B, and 0.13% or less at the point C, respectively, and the permanent strain rate in the direction perpendicular to the circumferential direction is 0% with the application of any pressure within the above range. After the application of the pressure of 2.4 MPa, the permanent strain rates in the circumferential direction are 0.37% at the point A, 0.25% at the point B, and 0.38% at the point C, respectively, and the permanent strain rate in the direction perpendicular to the circumferential direction is 0.02%. In the case where the pressure of 3.0 MPa is applied, the permanent strain rates in the circumferential direction are as small as 0.79% at the point A and 0.63% at the point B and the point C, and the permanent strain rate in the direction perpendicular to the circumferential direction is as small as 0.1%. Thus, with any one of the above pressures being applied, the permanent strain rates in the circumferential direction as well as the permanent strain rate in the direction perpendicular to the circumferential direction are less than 1% and are kept to be at most 0.8%, respectively. It is therefore recognized that the fire extinguisher cylinder 310 of Table 3 exerts pressure resistance at a level higher than that of the fire extinguisher cylinder 310 of Table 2.

Further, in the fire extinguisher cylinder 310 of Table 3, the maximum difference among the permanent strain rates at the respective measurement points is 0.69% (which is the difference between the permanent strain rate in the circumferential direction at the point A and the permanent strain rate in the direction perpendicular to the circumferential direction). Accordingly, the maximum difference among the permanent strain rates in the fire extinguisher cylinder 310 of Table 3 is smaller than the maximum difference among the permanent strain rates in each of the fire extinguisher cylinders 310 of Tables 1 and 2. The fire extinguisher cylinder 10 of Table 3 is therefore recognized as having variations of the permanent strain rates, which are smaller than the variations of the permanent strain rates of the fire extinguisher cylinders 310 of Tables 1 and 2.

In the fire extinguisher cylinder 310 of Table 4, even after the application of a pressure from 1.0 MPa to 2.0 MPa, the permanent strain rates in the circumferential direction are 0.1% or less at the point A, 0% at the point B, and 0.11% or less at the point C, respectively, and the permanent strain rate in the direction perpendicular to the circumferential direction is 0.1% or less with the application of any pressure within the above range. After the application of the pressure of 2.4 MPa, the permanent strain rates in the circumferential direction are 0.3% at the point A, 0.23% at the point B, and 0.34% at the point C, respectively, and the permanent strain rate in the direction perpendicular to the circumferential direction is 0.19%. In the case where the pressure of 3.0 MPa is applied, the permanent strain rates in the circumferential direction are as small as 0.65% at the point A and 0.56% at the point B and the point C, and the permanent strain rate in the direction perpendicular to the circumferential direction is as small as 0.49%. Thus, with any one of the above pressures being applied, the permanent strain rates in the circumferential direction as well as the permanent strain rate in the direction perpendicular to the circumferential direction are less than 1% and are kept to be at most 0.7%, respectively. It is therefore recognized that the fire extinguisher cylinder 310 of Table 4 exerts pressure resistance at a level higher than that of the fire extinguisher cylinder 310 of Table 2.

Further, in the fire extinguisher cylinder 310 of Table 4, the maximum difference among the permanent strain rates at the respective measurement points is 0.16% (which is the difference between the permanent strain rate in the circumferential direction at the point A and the permanent strain rate in the direction perpendicular to the circumferential direction). Accordingly, the maximum difference among the permanent strain rates in the fire extinguisher cylinder 310 of Table 4 is much smaller than the maximum difference among the permanent strain rates in each of the fire extinguisher cylinders 310 of Tables 1 and 2. The fire extinguisher cylinder 310 of Table 4 is therefore recognized as having variations of the permanent strain rates, which are smaller than the variations of the permanent strain rates of the fire extinguisher cylinders 310 of Tables 1 and 2.

In the fire extinguisher cylinder 310 of Table 5, even after the application of a pressure from 1.0 MPa to 2.0 MPa, the permanent strain rates in the circumferential direction are 0.08% or less at the point A, 0% at the point B, and 0.1% or less at the point C, respectively, and the permanent strain rate in the direction perpendicular to the circumferential direction is 0.19% or less with the application of any pressure within the above range. After the application of the pressure of 2.4 MPa, the permanent strain rates in the circumferential direction are 0.24% at the point A, 0.2% at the point B, and 0.3% at the point C, respectively, and the permanent strain rate in the direction perpendicular to the circumferential direction is 0.38%. In the case where the pressure of 3.0 MPa is applied, the permanent strain rates in the circumferential direction are as small as 0.52% at the point A and 0.51% at the point B and the point C, and the permanent strain rate in the direction perpendicular to the circumferential direction is as small as 0.79%. Thus, with any one of the above pressures being applied, the permanent strain rates in the circumferential direction as well as the permanent strain rate in the direction perpendicular to the circumferential direction are less than 1% and are kept to be at most 0.8%, respectively. It is therefore recognized that the fire extinguisher cylinder 310 of Table 5 exerts pressure resistance at a level higher than that of the fire extinguisher cylinder 310 of Table 2.

Further, in the fire extinguisher cylinder 310 of Table 5, the maximum difference among the permanent strain rates at the respective measurement points is 0.28% (which is the difference between the permanent strain rate in the circumferential direction at the point B or the point C and the permanent strain rate in the direction perpendicular to the circumferential direction). Accordingly, the maximum difference among the permanent strain rates in the fire extinguisher cylinder 310 of Table 5 is much smaller than the maximum difference among the permanent strain rates in each of the fire extinguisher cylinders 310 of Tables 1 and 2. The fire extinguisher cylinder 310 of Table 5 is therefore recognized as having variations of the permanent strain rates, which are smaller than the variations of the permanent strain rates of the fire extinguisher cylinders 310 of Tables 1 and 2.

In the fire extinguisher cylinder 310 of Table 6, even after the application of a pressure from 1.0 MPa to 2.0 MPa, the permanent strain rates in the circumferential direction are 0.06% or less at the point A, 0% at the point B, and 0.09% or less at the point C, respectively, and the permanent strain rate in the direction perpendicular to the circumferential direction is 0.19% or less with the application of any pressure within the above range. After the application of the pressure of 2.4 MPa, the permanent strain rates in the circumferential direction are 0.19% at the point A, 0.18% at the point B, and 0.27% at the point C, respectively, and the permanent strain rate in the direction perpendicular to the circumferential direction is 0.57%. In the case where the pressure of 3.0 MPa is applied, the permanent strain rates in the circumferential direction are as small as 0.42% at the point A and 0.46% at the point B and the point C, and the permanent strain rate in the direction perpendicular to the circumferential direction is 0.88%. Thus, with any one of the above pressures being applied, the permanent strain rates in the circumferential direction as well as the permanent strain rate in the direction perpendicular to the circumferential direction are less than 1% and are kept to be at most 0.9%, respectively. It is therefore recognized that the fire extinguisher cylinder 310 of Table 6 exerts sufficient pressure resistance required to a fire extinguisher cylinder.

Further, in the fire extinguisher cylinder 310 of Table 6, the maximum difference among the permanent strain rates at the respective measurement points is 0.46% (which is the difference between the permanent strain rate in the circumferential direction at the point A and the permanent strain rate in the direction perpendicular to the circumferential direction). Accordingly, the maximum difference among the permanent strain rates in the fire extinguisher cylinder 310 of Table 6 is smaller than the maximum difference among the permanent strain rates in each of the fire extinguisher cylinders 310 of Tables 1 and 2. The fire extinguisher cylinder 310 of Table 6 is therefore recognized as having variations of the permanent strain rates, which are smaller than the variations of the permanent strain rates of the fire extinguisher cylinders 310 of Tables 1 and 2.

In the fire extinguisher cylinder 310 of Table 7, even after the application of a pressure from 1.0 MPa to 2.0 MPa, the permanent strain rates in the circumferential direction are 0.05% or less at the point A, 0% at the point B, and 0.09% or less at the point C, respectively, and the permanent strain rate in the direction perpendicular to the circumferential direction is 0.23% or less with the application of any pressure within the above range. After the application of the pressure of 2.4 MPa, the permanent strain rates in the circumferential direction are 0.15% at the point A, 0.14% at the point B, and 0.21% at the point C, respectively, and the permanent strain rate in the direction perpendicular to the circumferential direction is 0.68%. However, in the case where the pressure of 3.0 MPa is applied, the permanent strain rate in the direction perpendicular to the circumferential direction is as large as 1.01%.

As described above, according to Tables 1 to 7, in the fire extinguisher cylinder 310, of which preform has a thickness of 15 mm±0.4 mm at the site corresponding to the body portion 393 of the final molded component and of which the body portion 393 has the stretch factor in the circumferential direction being from 1.05 to 1.4 times the stretch factor in the direction perpendicular to the circumferential direction, the absolute values of the permanent strain rates are less than 1% even in the case where the pressure of 3 MPa is applied. The fire extinguisher cylinder 310 is thus recognized as sufficiently securing pressure resistance required to a fire extinguisher cylinder. It is preferable, in view of the achievement of pressure resistance at a high level, to obtain a product from 12 to 13 by multiplying the stretch factor in scalar quantity in the circumferential direction by the stretch factor in scalar quantity in the direction perpendicular to the circumferential direction.

In particular, in the fire extinguisher cylinder 210 having the stretch factor at the body portion 393 in the circumferential direction being from 1.12 to 1.26 times the stretch factor thereat in the direction perpendicular to the circumferential direction, the absolute values of the permanent strain rates are 0.8% or less and the variations of the permanent strain rates are small. Accordingly, the fire extinguisher cylinder of the characteristics specified above can exert pressure resistance at a still higher level, in a preferable aspect of the present invention. In this case, it is preferable, in view of the achievement of pressure resistance at a further higher level, to obtain a product from 12.09 to 12.21 by multiplying the stretch factor in the circumferential direction by the stretch factor in the direction perpendicular to the circumferential direction.

Fourth Embodiment

A fire extinguisher 400 according to the present embodiment has a configuration same as that of the fire extinguisher according to the third embodiment except a feature that a fire extinguisher cylinder 410 is included in place of the fire extinguisher cylinder 310 of the third embodiment. Accordingly, there will not be repeatedly provided the description same as that of the third embodiment.

The fire extinguisher cylinder 410 according to the present embodiment is preferably shaped to have a body portion 493 of a thickness (T3) of 1.6 mm±0.4 mm. The fire extinguisher cylinder 410 of such a thickness can realize pressure resistance at a level (such as approximately 2.0 MPa) required to a fire extinguisher cylinder and appropriate visibility for visual recognition of the contained fire extinguishant. The fire extinguisher 400 according to the present embodiment has a superior feature of being made of a material of a quantity smaller than that of the fire extinguisher cylinder 310 according to the third embodiment. In other words, the fire extinguisher 400 of the present embodiment realizes more reduction in manufacturing cost in comparison to the fire extinguisher 300 of the third embodiment. However, if the fire extinguisher cylinder 310 of the third embodiment is compared with the fire extinguisher cylinder 410 of the present embodiment both of which have same stretch factors, the fire extinguisher cylinder 310 of the third embodiment has pressure resistance better than that of the fire extinguisher cylinder 410 of the present embodiment.

Similarly to the fire extinguisher cylinder of the third embodiment, the final molded component of the fire extinguisher cylinder 410 is formed to have a stretch factor at the body portion 493 in the circumferential direction being from 1.05 to 1.4 times a stretch factor thereat in the direction perpendicular to the circumferential direction, as well as to obtain a product from 12 to 13 by multiplying the stretch factor at the body portion 493 in the circumferential direction by the stretch factor thereat in the direction perpendicular to the circumferential direction.

With the fire extinguisher cylinder 410 as a representative example, described next is how pressure resistance is improved in the case where the body portion 493 is formed to have the stretch factor in the circumferential direction being from 1.05 to 1.4 times the stretch factor in the direction perpendicular to the circumferential direction, as well as to obtain a product from 12 to 13 by multiplying the stretch factor in the circumferential direction by the stretch factor in the direction perpendicular to the circumferential direction.

Tables 8 to 14 indicate measurement results of permanent strain rates when an inner portion of the fire extinguisher cylinder 410 is uniformly pressurized. The test results indicated in Tables 8 to 14 were obtained in the same testing method and in the same measurement method same as those of Tables 1 to 7 in the third embodiment.

Table 8 indicates results of tests performed on the fire extinguisher cylinder 410, of which preform has a thickness of 13 mm±0.4 mm at the site corresponding to the body portion 493 of the final molded component, of which stretch factor at the body portion 493 in the circumferential direction is 3.5, and of which stretch factor thereat in the direction perpendicular to the circumferential direction is 3.5. In other words, at the body portion 493 of the fire extinguisher cylinder 410 of Table 8, the proportion of the stretch factor (3.5) in the direction perpendicular to the circumferential direction to the stretch factor (3.5) in the circumferential direction is 1:1. Further, when the stretch factors are respectively considered in scalar quantity, a product of 12.25 is obtained by multiplying the stretch factor in scalar quantity in the circumferential direction by the stretch factor in scalar quantity in the direction perpendicular to the circumferential direction.

Table 9 indicates results of tests performed on the fire extinguisher cylinder 410, of which preform has a thickness of 13 mm±0.4 mm at the site corresponding to the body portion 493 of the final molded component, of which stretch factor at the body portion 493 in the circumferential direction is 3.6, and of which stretch factor thereat in the direction perpendicular to the circumferential direction is 3.4. In other words, at the body portion 493 of the fire extinguisher cylinder 410 of Table 9, the proportion of the stretch factor (3.4) in the direction perpendicular to the circumferential direction to the stretch factor (3.6) in the circumferential direction is 1:1.06. Further, when the stretch factors are respectively considered in scalar quantity, a product of 12.24 is obtained by multiplying the stretch factor in scalar quantity in the circumferential direction by the stretch factor in scalar quantity in the direction perpendicular to the circumferential direction.

Table 10 indicates results of tests performed on the fire extinguisher cylinder 410, of which preform has a thickness of 13 mm±0.4 mm at the site corresponding to the body portion 493 of the final molded component, of which stretch factor at the body portion 493 in the circumferential direction is 3.7, and of which stretch factor thereat in the direction perpendicular to the circumferential direction is 3.3. In other words, at the body portion 493 of the fire extinguisher cylinder 410 of Table 10, the proportion of the stretch factor (3.3) in the direction perpendicular to the circumferential direction to the stretch factor (3.7) in the circumferential direction is 1:1.12. Further, when the stretch factors are respectively considered in scalar quantity, a product of 12.21 is obtained by multiplying the stretch factor in scalar quantity in the circumferential direction by the stretch factor in scalar quantity in the direction perpendicular to the circumferential direction.

Table 11 indicates results of tests performed on the fire extinguisher cylinder 410, of which preform has a thickness of 13 mm±0.4 mm at the site corresponding to the body portion 493 of the final molded component, of which stretch factor at the body portion 493 in the circumferential direction is 3.8, and of which stretch factor thereat in the direction perpendicular to the circumferential direction is 3.2. In other words, at the body portion 493 of the fire extinguisher cylinder 410 of Table 11, the proportion of the stretch factor (3.2) in the direction perpendicular to the circumferential direction to the stretch factor (3.8) in the circumferential direction is 1:1.19. Further, when the stretch factors are respectively considered in scalar quantity, a product of 12.16 is obtained by multiplying the stretch factor in scalar quantity in the circumferential direction by the stretch factor in scalar quantity in the direction perpendicular to the circumferential direction.

Table 12 indicates results of tests performed on the fire extinguisher cylinder 410, of which preform has a thickness of 13 mm±0.4 mm at the site corresponding to the body portion 493 of the final molded component, of which stretch factor at the body portion 493 in the circumferential direction is 3.9, and of which stretch factor thereat in the direction perpendicular to the circumferential direction is 3.1. In other words, at the body portion 493 of the fire extinguisher cylinder 410 of Table 12, the proportion of the stretch factor (3.1) in the direction perpendicular to the circumferential direction to the stretch factor (3.9) in the circumferential direction is 1:1.26. Further, when the stretch factors are respectively considered in scalar quantity, a product of 12.09 is obtained by multiplying the stretch factor in scalar quantity in the circumferential direction by the stretch factor in scalar quantity in the direction perpendicular to the circumferential direction.

Table 13 indicates results of tests performed on the fire extinguisher cylinder 410, of which preform has a thickness of 13 mm±0.4 mm at the site corresponding to the body portion 493 of the final molded component, of which stretch factor at the body portion 493 in the circumferential direction is 4.0, and of which stretch factor thereat in the direction perpendicular to the circumferential direction is 3.0. In other words, at the body portion 493 of the fire extinguisher cylinder 410 of Table 13, the proportion of the stretch factor (3.0) in the direction perpendicular to the circumferential direction to the stretch factor (4.0) in the circumferential direction is 1:1.33. Further, when the stretch factors are respectively considered in scalar quantity, a product of 12 is obtained by multiplying the stretch factor in scalar quantity in the circumferential direction by the stretch factor in scalar quantity in the direction perpendicular to the circumferential direction.

Table 14 indicates results of tests performed on the fire extinguisher cylinder 410, of which preform has a thickness of 13 mm±0.4 mm at the site corresponding to the body portion 493 of the final molded component, of which stretch factor at the body portion 493 in the circumferential direction is 4.1, and of which stretch factor thereat in the direction perpendicular to the circumferential direction is 2.9. In other words, at the body portion 493 of the fire extinguisher cylinder 410 of Table 14, the proportion of the stretch factor (2.9) in the direction perpendicular to the circumferential direction to the stretch factor (4.1) in the circumferential direction is 1:1.41. Further, when the stretch factors are respectively considered in scalar quantity, a product of 11.89 is obtained by multiplying the stretch factor in scalar quantity in the circumferential direction by the stretch factor in scalar quantity in the direction perpendicular to the circumferential direction.

TABLE 8

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.16 | 0.00 | 0.16 | 0.00 | 0.16 |
| 2.0 | 0.16 | 0.00 | 0.16 | 0.00 | 0.16 |
| 2.4 | 0.48 | 0.32 | 0.48 | 0.00 | 0.48 |
| 3.0 | 1.03 | 0.80 | 0.80 | 0.00 | 1.03 |

Fourth embodiment
Stretch factor in circumferential direction: 3.5
Stretch factor in direction perpendicular to circumferential direction: 3.5

TABLE 9

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.14 | 0.00 | 0.15 | 0.00 | 0.15 |
| 2.0 | 0.14 | 0.00 | 0.15 | 0.00 | 0.15 |

TABLE 9-continued

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 2.4 | 0.43 | 0.29 | 0.44 | 0.00 | 0.44 |
| 3.0 | 0.94 | 0.72 | 0.73 | 0.00 | 0.94 |

Fourth embodiment
Stretch factor in circumferential direction: 3.6
Stretch factor in direction perpendicular to circumferential direction: 3.4

TABLE 10

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.13 | 0.00 | 0.13 | 0.00 | 0.13 |
| 2.0 | 0.13 | 0.00 | 0.13 | 0.00 | 0.13 |
| 2.4 | 0.39 | 0.26 | 0.40 | 0.02 | 0.38 |
| 3.0 | 0.79 | 0.66 | 0.66 | 0.10 | 0.69 |

Fourth embodiment
Stretch factor in circumferential direction: 3.7
Stretch factor in direction perpendicular to circumferential direction: 3.3

TABLE 11

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.11 | 0.00 | 0.12 | 0.00 | 0.12 |
| 2.0 | 0.11 | 0.00 | 0.12 | 0.10 | 0.12 |
| 2.4 | 0.32 | 0.24 | 0.36 | 0.20 | 0.16 |
| 3.0 | 0.68 | 0.59 | 0.59 | 0.52 | 0.16 |

Fourth embodiment
Stretch factor in circumferential direction: 3.8
Stretch factor in direction perpendicular to circumferential direction: 3.2

TABLE 12

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.08 | 0.00 | 0.11 | 0.00 | 0.11 |
| 2.0 | 0.08 | 0.00 | 0.11 | 0.20 | 0.20 |
| 2.4 | 0.25 | 0.21 | 0.32 | 0.40 | 0.19 |
| 3.0 | 0.55 | 0.53 | 0.53 | 0.80 | 0.30 |

Fourth embodiment
Stretch factor in circumferential direction: 3.9
Stretch factor in direction perpendicular to circumferential direction: 3.1

TABLE 13

| Pressure (MPa) | Permanent Strain Rates (%) Circumferential Direction A | B | C | Direction Perpendicular to Circumferential Direction | Maximum Difference among Permanent Strain Rates |
|---|---|---|---|---|---|
| 1.0 | 0.00 | 0.00 | 0.00 | 0.00 | 0.00 |
| 1.6 | 0.07 | 0.00 | 0.10 | 0.01 | 0.10 |
| 2.0 | 0.07 | 0.00 | 0.10 | 0.20 | 0.20 |
| 2.4 | 0.20 | 0.19 | 0.29 | 0.60 | 0.41 |
| 3.0 | 0.44 | 0.48 | 0.48 | 0.93 | 0.49 |

Fourth embodiment
Stretch factor in circumferential direction: 4.0
Stretch factor in direction perpendicular to circumferential direction: 3.0

TABLE 14

| Pressure (MPa) | Permanent Strain Rates (%) Circumferential Direction A | B | C | Direction Perpendicular to Circumferential Direction | Maximum Difference among Permanent Strain Rates |
|---|---|---|---|---|---|
| 1.0 | 0.00 | 0.00 | 0.00 | 0.00 | 0.00 |
| 1.6 | 0.07 | 0.00 | 0.11 | 0.01 | 0.11 |
| 2.0 | 0.07 | 0.00 | 0.11 | 0.22 | 0.22 |
| 2.4 | 0.22 | 0.21 | 0.32 | 0.66 | 0.45 |
| 3.0 | 0.48 | 0.53 | 0.53 | 1.03 | 0.50 |

Fourth embodiment
Stretch factor in circumferential direction: 4.1
Stretch factor in direction perpendicular to circumferential direction: 2.9

In the fire extinguisher cylinder 410 of Table 8, even after the application of a pressure from 1.0 MPa to 2.0 MPa, the permanent strain rates in the circumferential direction are 0.16% or less at the point A, 0% at the point B, and 0.16% or less at the point C, respectively, and the permanent strain rate in the direction perpendicular to the circumferential direction is 0% with the application of any pressure within the above range. After the application of the pressure of 2.4 MPa, the permanent strain rates in the circumferential direction are 0.48% at the point A, 0.32% at the point B, and 0.48% at the point C, respectively, and the permanent strain rate in the direction perpendicular to the circumferential direction is 0%. However, in the case where the pressure of 3.0 MPa is applied, the permanent strain rate in the circumferential direction is as large as 1.03% at the point A.

In the fire extinguisher cylinder 410 of Table 9, even after the application of a pressure from 1.0 MPa to 2.0 MPa, the permanent strain rates in the circumferential direction are 0.14% or less at the point A, 0% at the point B, and 0.15% or less at the point C, respectively, and the permanent strain rate in the direction perpendicular to the circumferential direction is 0% with the application of any pressure within the above range. After the application of the pressure of 2.4 MPa, the permanent strain rates in the circumferential direction are 0.43% at the point A, 0.29% at the point B, and 0.44% at the point C, respectively, and the permanent strain rate in the direction perpendicular to the circumferential direction is 0%. In the case where the pressure of 3.0 MPa is applied, the permanent strain rates in the circumferential direction are 0.94% at the point A, 0.72% at the point B, and 0.73% at the point C, respectively, and the permanent strain rate in the direction perpendicular to the circumferential direction remains 0%. Thus, with any one of the above pressures being applied, the permanent strain rates in the circumferential direction as well as the permanent strain rate in the direction perpendicular to the circumferential direction are kept to be less than 1%, respectively. It is therefore recognized that the fire extinguisher cylinder 410 of Table 9 exerts sufficient pressure resistance required to a fire extinguisher cylinder.

In the fire extinguisher cylinder 410 of Table 10, even after the application of a pressure from 1.0 MPa to 2.0 MPa, the permanent strain rates in the circumferential direction are 0.13% or less at the point A, 0% at the point B, and 0.13% or less at the point C, respectively, and the permanent strain rate in the direction perpendicular to the circumferential direction is 0% with the application of any pressure within the above range. After the application of the pressure of 2.4 MPa, the permanent strain rates in the circumferential direction are 0.39% at the point A, 0.26% at the point B, and 0.40% at the point C, respectively, and the permanent strain rate in the direction perpendicular to the circumferential direction is 0.02%. In the case where the pressure of 3.0 MPa is applied, the permanent strain rates in the circumferential direction are as small as 0.79% at the point A and 0.66% at the point B and the point C, and the permanent strain rate in the direction perpendicular to the circumferential direction is as small as 0.1%. Thus, with any one of the above pressures being applied, the permanent strain rates in the circumferential direction as well as the permanent strain rate in the direction perpendicular to the circumferential direction are less than 1% and are kept to be at most 0.8%, respectively. It is therefore recognized that the fire extinguisher cylinder 410 of Table 10 exerts pressure resistance at a level higher than that of the fire extinguisher cylinder 410 of Table 9.

Further, in the fire extinguisher cylinder 410 of Table 10, the maximum difference among the permanent strain rates at the respective measurement points is 0.69% (which is the difference between the permanent strain rate in the circumferential direction at the point A and the permanent strain rate in the direction perpendicular to the circumferential direction). Accordingly, the maximum difference among the permanent strain rates in the fire extinguisher cylinder 410 of Table 10 is smaller than the maximum difference among the permanent strain rates in each of the fire extinguisher cylinders 410 of Tables 8 and 9. The fire extinguisher cylinder 410 of Table 10 is therefore recognized as having variations of the permanent strain rates, which are smaller than the variations of the permanent strain rates of the fire extinguisher cylinders 410 of Tables 8 and 9.

In the fire extinguisher cylinder 410 of Table 11, even after the application of a pressure from 1.0 MPa to 2.0 MPa, the permanent strain rates in the circumferential direction are 0.11% or less at the point A, 0% at the point B, and 0.12% or less at the point C, respectively, and the permanent strain rate in the direction perpendicular to the circumferential direction is 0.1% or less with the application of any pressure within the above range. After the application of the pressure of 2.4 MPa, the permanent strain rates in the circumferential direction are 0.32% at the point A, 0.24% at the point B, and 0.36% at the point C, respectively, and the permanent strain rate in the direction perpendicular to the circumferential direction is 0.2%. In the case where the pressure of 3.0 MPa is applied, the permanent strain rates in the circumferential direction are as small as 0.68% at the point A and 0.59% at the point B and the point C, and the permanent strain rate in the direction perpendicular to the circumferential direction is as small as 0.52%. Thus, with any one of the above pressures being applied, the permanent strain rates in the circumferential direction as well as the permanent strain rate in the direction perpendicular to the circumferential direction are less than 1% and are kept to be at most 0.7%, respectively. It is therefore recognized that the fire extinguisher cylinder 410 of Table 11 exerts pressure resistance at a level higher than that of the fire extinguisher cylinder 410 of Table 9.

Further, in the fire extinguisher cylinder 410 of Table 11, the maximum difference among the permanent strain rates at the respective measurement points is 0.16% (which is the difference between the permanent strain rate in the circumferential direction at the point A and the permanent strain rate in the direction perpendicular to the circumferential direction). Accordingly, the maximum difference among the permanent strain rates in the fire extinguisher cylinder 410 of Table 11 is much smaller than the maximum difference among the permanent strain rates in each of the fire extinguisher cylinders 410 of Tables 8 and 9. The fire extinguisher cylinder 410 of Table 11 is therefore recognized as having variations of the permanent strain rates, which are smaller than the variations of the permanent strain rates of the fire extinguisher cylinders 410 of Tables 8 and 9.

In the fire extinguisher cylinder 410 of Table 12, even after the application of a pressure from 1.0 MPa to 2.0 MPa, the permanent strain rates in the circumferential direction are 0.08% or less at the point A, 0% at the point B, and 0.11% or less at the point C, respectively, and the permanent strain rate in the direction perpendicular to the circumferential direction is 0.2% or less with the application of any pressure within the above range. After the application of the pressure of 2.4 MPa, the permanent strain rates in the circumferential direction are 0.25% at the point A, 0.21% at the point B, and 0.32% at the point C, respectively, and the permanent strain rate in the direction perpendicular to the circumferential direction is 0.4%. In the case where the pressure of 3.0 MPa is applied, the permanent strain rates in the circumferential direction are as small as 0.55% at the point A and 0.53% at the point B and the point C, and the permanent strain rate in the direction perpendicular to the circumferential direction is as small as 0.83%. Thus, with any one of the above pressures being applied, the permanent strain rates in the circumferential direction as well as the permanent strain rate in the direction perpendicular to the circumferential direction are less than 1% and are kept to be at most 0.8%, respectively. It is therefore recognized that the fire extinguisher cylinder 410 of Table 12 exerts pressure resistance at a level higher than that of the fire extinguisher cylinder 410 of Table 9.

Further, in the fire extinguisher cylinder 410 of Table 12, the maximum difference among the permanent strain rates at the respective measurement points is 0.3% (which is the difference between the permanent strain rate in the circumferential direction at the point B or the point C and the permanent strain rate in the direction perpendicular to the circumferential direction). Accordingly, the maximum difference among the permanent strain rates in the fire extinguisher cylinder 410 of Table 12 is much smaller than the maximum difference among the permanent strain rates in each of the fire extinguisher cylinders 410 of Tables 8 to 10. The fire extinguisher cylinder 410 of Table 12 is therefore recognized as having variations of the permanent strain rates, which are smaller than the variations of the permanent strain rates of the fire extinguisher cylinders 410 of Tables 8 and 9.

In the fire extinguisher cylinder 410 of Table 13, even after the application of a pressure from 1.0 MPa to 2.0 MPa, the permanent strain rates in the circumferential direction are 0.07% or less at the point A, 0% at the point B, and 0.1% or less at the point C, respectively, and the permanent strain rate in the direction perpendicular to the circumferential direction is 0.2% or less with the application of any pressure within the above range. After the application of the pressure of 2.4 MPa, the permanent strain rates in the circumferential direction are 0.2% at the point A, 0.19% at the point B, and 0.29% at the point C, respectively, and the permanent strain rate in the direction perpendicular to the circumferential direction is 0.6%. In the case where the pressure of 3.0 MPa is applied, the permanent strain rates in the circumferential direction are as small as 0.44% at the point A and 0.48% at the point B and the point C, and the permanent strain rate in the direction perpendicular to the circumferential direction is 0.93%. Thus, with any one of the above pressures being applied, the permanent strain rates in the circumferential direction as well as the permanent strain rate in the direction perpendicular to the circumferential direction are less than 1%, respectively. It is therefore recognized that the fire extinguisher cylinder 410 of Table 13 exerts sufficient pressure resistance required to a fire extinguisher cylinder.

In the fire extinguisher cylinder 410 of Table 14, even after the application of a pressure from 1.0 MPa to 2.0 MPa, the permanent strain rates in the circumferential direction are 0.07% or less at the point A, 0% at the point B, and 0.11% or less at the point C, respectively, and the permanent strain rate in the direction perpendicular to the circumferential direction is 0.22% or less with the application of any pressure within the above range. After the application of the pressure of 2.4 MPa, the permanent strain rates in the circumferential direction are 0.22% at the point A, 0.21% at the point B, and 0.32% at the point C, respectively, and the permanent strain rate in the direction perpendicular to the circumferential direction is 0.66%. However, in the case where the pressure of 3.0 MPa is applied, the permanent strain rate in the circumferential direction is 0.48% at the point A. In this case, the permanent strain rates in the circumferential direction are 0.53% at the point B and the point C. Further, the permanent strain rate in the direction perpendicular to the circumferential direction is as large as 1.03%.

As described above, according to Tables 8 to 14, in the fire extinguisher cylinder 410, of which preform has a thickness of 13 mm±0.4 mm at the site corresponding to the body portion 493 of the final molded component and of which the body portion 493 has the stretch factor in the circumferential direction being from 1.05 to 1.4 times the stretch factor in the direction perpendicular to the circumferential direction, the absolute values of the permanent strain rates are less than 1% even in the case where the pressure of 3 MPa is applied. The fire extinguisher cylinder 410 is thus recognized as sufficiently securing pressure resistance required to a fire extinguisher cylinder. It is preferable, in view of the achievement of pressure resistance at a high level, to obtain a product from 12 to 13 by multiplying the stretch factor in scalar quantity in the circumferential direction by the stretch factor in scalar quantity in the direction perpendicular to the circumferential direction.

In particular, in the fire extinguisher cylinder 410 having the stretch factor at the body portion 493 in the circumferential direction being from 1.12 to 1.26 times the stretch factor thereat in the direction perpendicular to the circumferential direction, the absolute values of the permanent strain rates are 0.8% or less and the variations of the permanent strain rates are small. Accordingly, the fire extinguisher cylinder of the characteristics specified above can exert pressure resistance at a still higher level, in a preferable aspect of the present invention. In this case, it is preferable, in view of the achievement of pressure resistance at a further higher level, to obtain a product from 12.09 to 12.21 by multiplying the stretch factor in the circumferential direction by the stretch factor in the direction perpendicular to the circumferential direction.

Fifth Embodiment

A fire extinguisher 500 according to the present embodiment has a configuration same as that of the fire extinguisher according to the third embodiment except a feature that a fire extinguisher cylinder 510 is included in place of the fire extinguisher cylinder 310 of the third embodiment. Accordingly, there will not be repeatedly provided the description same as that of the third embodiment.

The fire extinguisher cylinder 510 according to the present embodiment is preferably shaped to have a body portion 593 of a thickness (T3) of 2.4 mm±0.4 mm. The fire extinguisher cylinder 510 of such a thickness can realize pressure resistance at a level (such as approximately 2.0 MPa) required to a fire extinguisher cylinder and appropriate visibility for visual recognition of the contained fire extinguishant.

Similarly to the fire extinguisher cylinder of the third embodiment, the final molded component of the fire extinguisher cylinder 510 is formed to have a stretch factor at the body portion 593 in the circumferential direction being from 1.05 to 1.4 times a stretch factor thereat in the direction perpendicular to the circumferential direction, as well as to obtain a product from 12 to 13 by multiplying the stretch factor at the body portion 593 in the circumferential direction by the stretch factor thereat in the direction perpendicular to the circumferential direction.

With the fire extinguisher cylinder 510 as a representative example, described next is how pressure resistance is improved in the case where the body portion 593 is formed to have the stretch factor in the circumferential direction being from 1.05 to 1.4 times the stretch factor in the direction perpendicular to the circumferential direction, as well as to obtain a product from 12 to 13 by multiplying the stretch factor in the circumferential direction by the stretch factor in the direction perpendicular to the circumferential direction.

Table 15 indicates results of tests performed on the fire extinguisher cylinder 510, of which preform has a thickness of 19 mm±0.4 mm at the site corresponding to the body portion 593 of the final molded component, of which stretch factor at the body portion 593 in the circumferential direction is 3.5, and of which stretch factor thereat in the direction perpendicular to the circumferential direction is 3.5. In other words, at the body portion 593 of the fire extinguisher cylinder 510 of Table 15, the proportion of the stretch factor (3.5) in the direction perpendicular to the circumferential direction to the stretch factor (3.5) in the circumferential direction is 1:1. Further, when the stretch factors are respectively considered in scalar quantity, a product of 12.25 is obtained by multiplying the stretch factor in scalar quantity in the circumferential direction by the stretch factor in scalar quantity in the direction perpendicular to the circumferential direction.

Table 16 indicates results of tests performed on the fire extinguisher cylinder 510, of which preform has a thickness of 19 mm±0.4 mm at the site corresponding to the body portion 593 of the final molded component, of which stretch factor at the body portion 593 in the circumferential direction is 3.6, and of which stretch factor thereat in the direction perpendicular to the circumferential direction is 3.4. In other words, at the body portion 593 of the fire extinguisher cylinder 510 of Table 16, the proportion of the stretch factor (3.4) in the direction perpendicular to the circumferential direction to the stretch factor (3.6) in the circumferential direction is 1:1.06. Further, when the stretch factors are respectively considered in scalar quantity, a product of 12.24 is obtained by multiplying the stretch factor in scalar quantity in the circumferential direction by the stretch factor in scalar quantity in the direction perpendicular to the circumferential direction.

Table 17 indicates results of tests performed on the fire extinguisher cylinder 510, of which preform has a thickness of 19 mm±0.4 mm at the site corresponding to the body portion 593 of the final molded component, of which stretch factor at the body portion 593 in the circumferential direction is 3.7, and of which stretch factor thereat in the direction perpendicular to the circumferential direction is 3.3. In other words, at the body portion 593 of the fire extinguisher cylinder 510 of Table 17, the proportion of the stretch factor (3.3) in the direction perpendicular to the circumferential direction to the stretch factor (3.7) in the circumferential direction is 1:1.12. Further, when the stretch factors are respectively considered in scalar quantity, a product of 12.21 is obtained by multiplying the stretch factor in scalar quantity in the circumferential direction by the stretch factor in scalar quantity in the direction perpendicular to the circumferential direction.

Table 18 indicates results of tests performed on the fire extinguisher cylinder 510, of which preform has a thickness of 19 mm±0.4 mm at the site corresponding to the body portion 593 of the final molded component, of which stretch factor at the body portion 593 in the circumferential direction is 3.8, and of which stretch factor thereat in the direction perpendicular to the circumferential direction is 3.2. In other words, at the body portion 593 of the fire extinguisher cylinder 510 of Table 18, the proportion of the stretch factor (3.2) in the direction perpendicular to the circumferential direction to the stretch factor (3.8) in the circumferential direction is 1:1.19. Further, when the stretch factors are respectively considered in scalar quantity, a product of 12.16 is obtained by multiplying the stretch factor in scalar quantity in the circumferential direction by the stretch factor in scalar quantity in the direction perpendicular to the circumferential direction.

Table 19 indicates results of tests performed on the fire extinguisher cylinder 510, of which preform has a thickness of 19 mm±0.4 mm at the site corresponding to the body portion 593 of the final molded component, of which stretch factor at the body portion 593 in the circumferential direction is 3.9, and of which stretch factor thereat in the direction perpendicular to the circumferential direction is 3.1. In other words, at the body portion 593 of the fire extinguisher cylinder 510 of Table 19, the proportion of the stretch factor (3.1) in the direction perpendicular to the circumferential direction to the stretch factor (3.9) in the circumferential direction is 1:1.26. Further, when the stretch factors are respectively considered in scalar quantity, a product of 12.09 is obtained by multiplying the stretch factor in scalar quantity in the circumferential direction by the stretch factor in scalar quantity in the direction perpendicular to the circumferential direction.

Table 20 indicates results of tests performed on the fire extinguisher cylinder 510, of which preform has a thickness of 19 mm±0.4 mm at the site corresponding to the body portion 593 of the final molded component, of which stretch factor at the body portion 593 in the circumferential direction is 4.0, and of which stretch factor thereat in the direction perpendicular to the circumferential direction is 3.0. In other words, at the body portion 593 of the fire extinguisher cylinder 510 of Table 20, the proportion of the stretch factor (3.0) in the direction perpendicular to the circumferential direction to the stretch factor (4.0) in the circumferential direction is 1:1.33. Further, when the stretch factors are respectively considered in scalar quantity, a product of 12 is obtained by multiplying the stretch factor in scalar quantity in the circumferential direction by the stretch factor in scalar quantity in the direction perpendicular to the circumferential direction.

Table 21 indicates results of tests performed on the fire extinguisher cylinder 510, of which preform has a thickness of 19 mm±0.4 mm at the site corresponding to the body portion 593 of the final molded component, of which stretch factor at the body portion 593 in the circumferential direction is 4.1, and of which stretch factor thereat in the direction perpendicular to the circumferential direction is 2.9. In other words, at the body portion 593 of the fire extinguisher cylinder 510 of Table 21, the proportion of the stretch factor (2.9) in the direction perpendicular to the circumferential direction to the stretch factor (4.1) in the circumferential direction is 1:1.41. Further, when the stretch factors are respectively considered in scalar quantity, a product of 11.89 is obtained by multiplying the stretch factor in scalar quantity in the circumferential direction by the stretch factor in scalar quantity in the direction perpendicular to the circumferential direction.

TABLE 15

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.11 | 0.00 | 0.11 | 0.00 | 0.11 |
| 2.0 | 0.11 | 0.00 | 0.11 | 0.00 | 0.11 |
| 2.4 | 0.33 | 0.22 | 0.34 | 0.00 | 0.34 |
| 3.0 | 0.72 | 0.56 | 0.56 | 0.00 | 0.72 |

Fifth embodiment
Stretch factor in circumferential direction: 3.5
Stretch factor in direction perpendicular to circumferential direction: 3.5

TABLE 16

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.10 | 0.00 | 0.10 | 0.00 | 0.10 |
| 2.0 | 0.10 | 0.00 | 0.10 | 0.00 | 0.10 |
| 2.4 | 0.30 | 0.20 | 0.30 | 0.00 | 0.30 |
| 3.0 | 0.66 | 0.51 | 0.51 | 0.00 | 0.66 |

Fifth embodiment
Stretch factor in circumferential direction: 3.6
Stretch factor in direction perpendicular to circumferential direction: 3.4

TABLE 17

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.09 | 0.00 | 0.09 | 0.00 | 0.09 |
| 2.0 | 0.09 | 0.00 | 0.09 | 0.00 | 0.09 |
| 2.4 | 0.28 | 0.18 | 0.28 | 0.02 | 0.26 |
| 3.0 | 0.55 | 0.46 | 0.46 | 0.07 | 0.48 |

Fifth embodiment
Stretch factor in circumferential direction: 3.7
Stretch factor in direction perpendicular to circumferential direction: 3.3

TABLE 18

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.07 | 0.00 | 0.08 | 0.00 | 0.07 |
| 2.0 | 0.07 | 0.00 | 0.08 | 0.07 | 0.08 |
| 2.4 | 0.22 | 0.17 | 0.25 | 0.14 | 0.11 |
| 3.0 | 0.48 | 0.41 | 0.42 | 0.36 | 0.12 |

Fifth embodiment
Stretch factor in circumferential direction: 3.8
Stretch factor in direction perpendicular to circumferential direction: 3.2

TABLE 19

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.06 | 0.00 | 0.07 | 0.00 | 0.07 |
| 2.0 | 0.06 | 0.00 | 0.07 | 0.14 | 0.14 |
| 2.4 | 0.18 | 0.15 | 0.22 | 0.28 | 0.13 |
| 3.0 | 0.38 | 0.37 | 0.37 | 0.58 | 0.21 |

Fifth embodiment
Stretch factor in circumferential direction: 3.9
Stretch factor in direction perpendicular to circumferential direction: 3.1

TABLE 20

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.05 | 0.00 | 0.07 | 0.01 | 0.07 |
| 2.0 | 0.05 | 0.00 | 0.07 | 0.14 | 0.14 |
| 2.4 | 0.14 | 0.13 | 0.20 | 0.42 | 0.29 |
| 3.0 | 0.31 | 0.34 | 0.34 | 0.65 | 0.34 |

Fifth embodiment
Stretch factor in circumferential direction: 4.0
Stretch factor in direction perpendicular to circumferential direction: 3.0

TABLE 21

| Pressure | Permanent Strain Rates (%) Circumferential Direction | | | Direction Perpendicular to Circumferential | Maximum Difference among Permanent |
|---|---|---|---|---|---|
| (MPa) | A | B | C | Direction | Strain Rates |
| 1.0 | 0.00 | 0.00 | 0.00 | 0.00 | 0.00 |
| 1.6 | 0.05 | 0.00 | 0.07 | 0.01 | 0.07 |
| 2.0 | 0.05 | 0.00 | 0.07 | 0.15 | 0.15 |
| 2.4 | 0.16 | 0.15 | 0.22 | 0.46 | 0.31 |
| 3.0 | 0.34 | 0.37 | 0.37 | 0.68 | 0.34 |

Fifth embodiment
Stretch factor in circumferential direction: 4.1
Stretch factor in direction perpendicular to circumferential direction: 2.9

In the fire extinguisher cylinder 510 of Table 15, even after the application of a pressure from 1.0 MPa to 2.0 MPa, the permanent strain rates in the circumferential direction are 0.11% or less at the point A, 0% at the point B, and 0.11% or less at the point C, respectively, and the permanent strain rate in the direction perpendicular to the circumferential direction is 0% with the application of any pressure within the above range. After the application of the pressure of 2.4 MPa, the permanent strain rates in the circumferential direction are 0.33% at the point A, 0.22% at the point B, and 0.34% at the point C, respectively, and the permanent strain rate in the direction perpendicular to the circumferential direction is 0%. However, in the case where the pressure of 3.0 MPa is applied, the permanent strain rate in the circumferential direction is as large as 0.72% at the point A, which is less than 1%. In this case, the permanent strain rates in the circumferential direction are 0.56% at the point B and the point C, and the permanent strain rate in the direction perpendicular to the circumferential direction remains 0%. Thus, with any one of the above pressures being applied, the permanent strain rates in the circumferential direction as well as the permanent strain rate in the direction perpendicular to the circumferential direction are kept to be less than 1%, respectively. It is therefore recognized that the fire extinguisher cylinder 510 of Table 15 exerts sufficient pressure resistance required to a fire extinguisher cylinder.

In the fire extinguisher cylinder 510 of Table 16, even after the application of a pressure from 1.0 MPa to 2.0 MPa, the permanent strain rates in the circumferential direction are 0.10% or less at the point A, 0% at the point B, and 0.11% or less at the point C, respectively, and the permanent strain rate in the direction perpendicular to the circumferential direction is 0% with the application of any pressure within the above range. After the application of the pressure of 2.4 MPa, the permanent strain rates in the circumferential direction are 0.30% at the point A, 0.20% at the point B, and 0.30% at the point C, respectively, and the permanent strain rate in the direction perpendicular to the circumferential direction is 0%. In the case where the pressure of 3.0 MPa is applied, the permanent strain rates in the circumferential direction are 0.66% at the point A, 0.51% at the point B, and 0.51% at the point C, respectively, and the permanent strain rate in the direction perpendicular to the circumferential direction remains 0%. Thus, with any one of the above pressures being applied, the permanent strain rates in the circumferential direction as well as the permanent strain rate in the direction perpendicular to the circumferential direction are kept to be less than 1%, respectively. It is therefore recognized that the fire extinguisher cylinder 510 of Table 16 exerts sufficient pressure resistance required to a fire extinguisher cylinder.

In the fire extinguisher cylinder 510 of Table 17, even after the application of a pressure from 1.0 MPa to 2.0 MPa, the permanent strain rates in the circumferential direction are 0.09% or less at the point A, 0% at the point B, and 0.09% or less at the point C, respectively, and the permanent strain rate in the direction perpendicular to the circumferential direction is 0% with the application of any pressure within the above range. After the application of the pressure of 2.4 MPa, the permanent strain rates in the circumferential direction are 0.28% at the point A, 0.18% at the point B, and 0.28% at the point C, respectively, and the permanent strain rate in the direction perpendicular to the circumferential direction is 0.02%. In the case where the pressure of 3.0 MPa is applied, the permanent strain rates in the circumferential direction are as small as 0.55% at the point A and 0.46% at the point B and the point C, and the permanent strain rate in the direction perpendicular to the circumferential direction is as small as 0.07%. Thus, with any one of the above pressures being applied, the permanent strain rates in the circumferential direction as well as the permanent strain rate in the direction perpendicular to the circumferential direction are less than 1% and are kept to be at most 0.6%, respectively. It is therefore recognized that the fire extinguisher cylinder 510 of Table 17 exerts pressure resistance at a level higher than that of the fire extinguisher cylinder 510 of Table 16.

Further, in the fire extinguisher cylinder 510 of Table 17, the maximum difference among the permanent strain rates at the respective measurement points is 0.48% (which is the difference between the permanent strain rate in the circumferential direction at the point A and the permanent strain rate in the direction perpendicular to the circumferential direction). Accordingly, the maximum difference among the permanent strain rates in the fire extinguisher cylinder 510 of Table 17 is smaller than the maximum difference among the permanent strain rates in each of the fire extinguisher cylinders 510 of Tables 15 and 16. The fire extinguisher cylinder 510 of Table 17 is therefore recognized as having variations of the permanent strain rates, which are smaller than the variations of the permanent strain rates of the fire extinguisher cylinders 510 of Tables 15 and 16.

In the fire extinguisher cylinder 510 of Table 18, even after the application of a pressure from 1.0 MPa to 2.0 MPa, the permanent strain rates in the circumferential direction are 0.07% or less at the point A, 0% at the point B, and 0.08% or less at the point C, respectively, and the permanent strain rate in the direction perpendicular to the circumferential direction is 0.1% or less with the application of any pressure within the above range. After the application of the pressure of 2.4 MPa, the permanent strain rates in the circumferential direction are 0.22% at the point A, 0.17% at the point B, and 0.25% at the point C, respectively, and the permanent strain rate in the direction perpendicular to the circumferential direction is 0.14%. In the case where the pressure of 3.0 MPa is applied, the permanent strain rates in the circumferential direction are as small as 0.48% at the point A, 0.41% at the point B, and 0.42% at the point C, respectively, and the permanent strain rate in the direction perpendicular to the circumferential direction is as small as 0.36%. Thus, with any one of the above pressures being applied, the permanent strain rates in the circumferential direction as well as the permanent strain rate in the direction perpendicular to the circumferential direction are less than 1% and are kept to be at most 0.5%, respectively. It is therefore recognized that the fire extinguisher cylinder 510 of Table 18 exerts pressure resistance at a level higher than that of the fire extinguisher cylinder 510 of Table 17.

Further, in the fire extinguisher cylinder 510 of Table 18, the maximum difference among the permanent strain rates at the respective measurement points is 0.12% (which is the difference between the permanent strain rate in the circumferential direction at the point A and the permanent strain rate in the direction perpendicular to the circumferential direction). Accordingly, the maximum difference among the permanent strain rates in the fire extinguisher cylinder 510 of Table 18 is much smaller than the maximum difference among the permanent strain rates in each of the fire extinguisher cylinders 510 of Tables 15 and 16. The fire extinguisher cylinder 510 of Table 18 is therefore recognized as having variations of the permanent strain rates, which are significantly smaller than the variations of the permanent strain rates of the fire extinguisher cylinders 510 of Tables 15 and 16.

In the fire extinguisher cylinder 510 of Table 19, even after the application of a pressure from 1.0 MPa to 2.0 MPa, the permanent strain rates in the circumferential direction are 0.06% or less at the point A, 0% at the point B, and 0.07% or less at the point C, respectively, and the permanent strain rate in the direction perpendicular to the circumferential direction is 0.14% or less with the application of any pressure within the above range. After the application of the pressure of 2.4 MPa, the permanent strain rates in the circumferential direction are 0.18% at the point A, 0.15% at the point B, and 0.22% at the point C, respectively, and the permanent strain rate in the direction perpendicular to the circumferential direction is 0.28%. In the case where the pressure of 3.0 MPa is applied, the permanent strain rates in the circumferential direction are as small as 0.38% at the point A and 0.37% at the point B and the point C, and the permanent strain rate in the direction perpendicular to the circumferential direction is as small as 0.58%. Thus, with any one of the above pressures being applied, the permanent strain rates in the circumferential direction as well as the permanent strain rate in the direction perpendicular to the circumferential direction are less than 1% and are kept to be at most 0.6%, respectively. It is therefore recognized that the fire extinguisher cylinder 510 of Table 19 exerts pressure resistance at a level higher than that of the fire extinguisher cylinder 510 of Table 16.

Further, in the fire extinguisher cylinder 510 of Table 19, the maximum difference among the permanent strain rates at the respective measurement points is 0.21% (which is the difference between the permanent strain rate in the circumferential direction at the point B or the point C and the permanent strain rate in the direction perpendicular to the circumferential direction). Accordingly, the maximum difference among the permanent strain rates in the fire extinguisher cylinder 510 of Table 19 is much smaller than the maximum difference among the permanent strain rates in each of the fire extinguisher cylinders 510 of Tables 15 and 16. The fire extinguisher cylinder 510 of Table 19 is therefore recognized as having variations of the permanent strain rates, which are significantly smaller than the variations of the permanent strain rates of the fire extinguisher cylinders 510 of Tables 15 and 16.

In the fire extinguisher cylinder 510 of Table 20, even after the application of a pressure from 1.0 MPa to 2.0 MPa, the permanent strain rates in the circumferential direction are 0.05% or less at the point A, 0% at the point B, and 0.07% or less at the point C, respectively, and the permanent strain rate in the direction perpendicular to the circumferential direction is 0.14% or less with the application of any pressure within the above range. After the application of the pressure of 2.4 MPa, the permanent strain rates in the circumferential direction are 0.14% at the point A, 0.13% at the point B, and 0.20% at the point C, respectively, and the permanent strain rate in the direction perpendicular to the circumferential direction is 0.42%. In the case where the pressure of 3.0 MPa is applied, the permanent strain rates in the circumferential direction are as small as 0.31% at the point A and 0.34% at the point B and the point C, and the permanent strain rate in the direction perpendicular to the circumferential direction is 0.65%. Thus, with any one of the above pressures being applied, the permanent strain rates in the circumferential direction as well as the permanent strain rate in the direction perpendicular to the circumferential direction are kept to be less than 0.7%, respectively. It is therefore recognized that the fire extinguisher cylinder 510 of Table 20 exerts sufficient pressure resistance required to a fire extinguisher cylinder.

Further, in the fire extinguisher cylinder 510 of Table 20, the maximum difference among the permanent strain rates at the respective measurement points is 0.34% (which is the difference between the permanent strain rate in the circumferential direction at the point A and the permanent strain rate in the direction perpendicular to the circumferential direction). Accordingly, the maximum difference among the permanent strain rates in the fire extinguisher cylinder 510 of Table 20 is much smaller than the maximum difference among the permanent strain rates in each of the fire extinguisher cylinders 510 of Tables 15 and 16. The fire extinguisher cylinder 510 of Table 20 is therefore recognized as having variations of the permanent strain rates, which are significantly smaller than the variations of the permanent strain rates of the fire extinguisher cylinders 510 of Tables 15 and 16.

In the fire extinguisher cylinder 510 of Table 21, even after the application of a pressure from 1.0 MPa to 2.0 MPa, the permanent strain rates in the circumferential direction are 0.05% or less at the point A, 0% at the point B, and 0.07% or less at the point C, respectively, and the permanent strain rate in the direction perpendicular to the circumferential direction is 0.15% or less. After the application of the pressure of 2.4 MPa, the permanent strain rates in the circumferential direction are 0.16% at the point A, 0.15% at the point B, and 0.22% at the point C, respectively, and the permanent strain rate in the direction perpendicular to the circumferential direction is 0.46%. However, in the case where the pressure of 3.0 MPa is applied, the permanent strain rate in the circumferential direction is 0.34% at the point A. In this case, the permanent strain rates in the circumferential direction are 0.37% at the point B and the point C. Further, the permanent strain rate in the direction perpendicular to the circumferential direction is as large as 0.68%, which is less than 0.7%. Thus, with any one of the above pressures being applied, the permanent strain rates in the circumferential direction as well as the permanent strain rate in the direction perpendicular to the circumferential direction are kept to be less than 0.7%, respectively. It is therefore recognized that the fire extinguisher cylinder 510 of Table 21 exerts sufficient pressure resistance required to a fire extinguisher cylinder.

As described above, according to Tables 15 to 21, in the fire extinguisher cylinder 510, of which preform has a thickness of 19 mm±0.4 mm at the site corresponding to the body portion 593 of the final molded component and of which the body portion 593 has the stretch factor in the circumferential direction being from 1.05 to 1.4 times the stretch factor in the direction perpendicular to the circumferential direction, the absolute values of the permanent strain rates are less than 1% even in the case where the pressure of 3 MPa is applied. The fire extinguisher cylinder 510 is thus recognized as sufficiently securing pressure resistance required to a fire extinguisher cylinder. It is preferable, in view of the achievement of pressure resistance at a high level, to obtain a product from 11 to 13 by multiplying the stretch factor in scalar quantity in the circumferential direction by the stretch factor in scalar quantity in the direction perpendicular to the circumferential direction.

In particular, in the fire extinguisher cylinder 510 having the stretch factor at the body portion 593 in the circumferential direction being from 1.12 to 1.26 times the stretch factor thereat in the direction perpendicular to the circumferential direction, the absolute values of the permanent strain rates are 0.8% or less and the variations of the permanent strain rates are significantly small. Accordingly, the fire extinguisher cylinder of the characteristics specified above can exert pressure resistance at a still higher level, in a preferable aspect of the present invention. In this case, it is preferable, in view of the achievement of pressure resistance at a further higher level, to obtain a product from 11.89 to 12.21 by multiplying the stretch factor in the circumferential direction by the stretch factor in the direction perpendicular to the circumferential direction.

Although there is required a material of a quantity larger than that for the fire extinguisher cylinder 310 of the third embodiment, the fire extinguisher 500 according to the present embodiment exerts pressure resistance at a level higher than that of the fire extinguisher cylinder 310. However, in a case where the fire extinguisher cylinder 310 of the third embodiment is compared with the fire extinguisher cylinder 510 of the present embodiment both of which have the same stretch factors, the fire extinguisher cylinder 310 of the third embodiment can be made of the material of a quantity smaller than that for the fire extinguisher cylinder 510 of the present embodiment, thereby being superior in terms of reduction in manufacturing cost therefor.

Sixth Embodiment

A fire extinguisher 600 according to the present embodiment has a configuration same as that of the fire extinguisher 100 according to the first embodiment except a feature that a fire extinguisher cylinder 610 is included in place of the fire extinguisher cylinder 10 of the first embodiment. Accordingly, there will not be repeatedly provided the description same as that of the first embodiment.

In the fire extinguisher cylinder 610 of the present embodiment, a mouth portion 691 has a thickness (T1) from 2 mm to 5 mm, and a shoulder portion 692 has a thickness (T2) from 1.2 mm to 12 mm. A body portion 693 has a thickness (T3) from 1.3 mm to 1.7 mm, and a bottom portion 694 has a thickness (T4) from 1.2 mm to 12 mm. The fire extinguisher cylinder 610 according to the present embodiment has a whole light transmittance of approximately 50%. The fire extinguisher cylinder 610 of the present embodiment is made only of polyethylene naphthalate (PEN) if disregarding impurities mixed during the manufacturing process.

The fire extinguisher cylinder 610 according to the present embodiment has a whole light transmittance from 5% to 75%. In a case where the whole light transmittance exceeds 75% in the fire extinguisher cylinder 610, a fire extinguishant contained in the cylinder and adhering to the wall surface of the cylinder looks like dirt on the fire extinguisher, thereby causing deterioration in visual quality of the place around the installed fire extinguisher 100. On the other hand, in a case where the whole light transmittance thereof is less than 5%, the residual quantity of the fire extinguishant is hard to be checked in emergency, which deteriorates utility of the fire extinguisher. Accordingly, appropriate transparency kept in the above range achieves harmonization between utility and visual quality of the outer appearance. It is more preferable that the fire extinguisher cylinder 610 has a whole light transmittance from 20% to 70%. The whole light transmittance in this range realizes better harmonization with visual quality around the location of installation.

In the fire extinguisher cylinder 610 according to the present embodiment, the thickness (T3) of the body portion 693 is preferably from 1 mm to 5 mm. If the thickness of the resin is less than 1 mm, it may not be possible to achieve strength at a level (such as approximately 2.0 MPa) required to a fire extinguisher cylinder. On the other hand, if the thickness thereof is more than 5 mm, such a cylinder is not economically preferable and may not be possible to achieve transparency enough to visually recognize the fire extinguishant contained therein. In view of the above, the thickness (T3) of the body portion 693 is more preferably from 1 mm to 3 mm.

The fire extinguisher cylinder 610 made of polyethylene naphthalate (PEN) can be manufactured by adopting one of the conventionally known resin molding methods such as stretch blow molding and melting molding. Among these, stretch blow molding is preferably adopted because the resultant cylinder is provided with no joint, is well shaped, and has an appropriate thickness. In the case of manufacturing the cylinder by stretch blow molding, it is preferable to obtain a product of 12 or more by multiplying the stretch factor in scalar quantity at the body portion 693 in the circumferential direction by the stretch factor in scalar quantity in the direction perpendicular to the circumferential direction. In this case, the preform of the fire extinguisher cylinder 610 preferably has a whole light transmittance from 5% to 75%. In addition, the preform of the fire extinguisher cylinder 10 preferably has a thickness from 4 mm to 30 mm (most preferably 15 mm) so that the thickness (T3) of the body portion 693 is from 1 mm to 5 mm in the final molded component.

In a case where the whole light transmittance exceeds 75% in the preform of the fire extinguisher cylinder 610, the fire extinguishant contained in the cylinder and adhering to the wall surface of the fire extinguisher cylinder 610 having been processed by stretch blow molding looks like dirt on the fire extinguisher, thereby causing deterioration in visual quality of the place around the installed fire extinguisher 600. On the other hand, in a case where the whole light transmittance of the preform is less than 5%, the residual quantity of the fire extinguishant contained in the fire extinguisher cylinder 610 having been processed by stretch blow molding is hard to be checked in emergency, which deteriorates utility of the fire extinguisher. Accordingly, also in the preform of the fire extinguisher cylinder 610, transparency kept in the above range achieves harmonization between utility and visual quality of the outer appearance of the fire extinguisher cylinder 610 having been processed by stretch blow molding. However, even if the above preform is made too thick, transparency is deteriorated in the fire extinguisher cylinder 610 having been processed by stretch blow molding.

As described above, by the adoption of stretch blow molding inclusive of the stretching step, polymer chains of the resin are oriented substantially in one direction. Accordingly improved are transparency, strength, and rigidity of the resin. Therefore, adoption of stretch blow molding efficiently realizes improvement in transparency and pressure resistance of the fire extinguisher cylinder 610 according to the present embodiment. In a different aspect, the fire extinguisher cylinder 610 preferably has a bottom surface in a spherical shape so as to substantially equalize the stretch factors in the bottom surface.

Seventh Embodiment

A fire extinguisher 700 according to the present embodiment has a configuration same as that of the fire extinguisher according to the sixth embodiment except a feature that a fire extinguisher cylinder 710 is made of polyethylene terephthalate (PET) as well as except the thickness of the preform during the manufacturing process and the stretch blow factors. Accordingly, there will not be repeatedly provided the description same as that of the sixth embodiment.

The fire extinguisher 700 according to the present embodiment includes the fire extinguisher cylinder 710 made of polyethylene terephthalate (PET). In the fire extinguisher cylinder 710 of the present embodiment, a mouth portion 791 has a thickness (T1) from 2 mm to 5 mm, and a shoulder portion 792 has a thickness (T2) from 2 mm to 12 mm. A body portion 793 has a thickness (T3) from 2 mm to 3 mm, and a bottom portion 794 has a thickness (T4) from 2 mm to 12 mm. The fire extinguisher cylinder 710 according to the present embodiment has a whole light transmittance of approximately 50%. The fire extinguisher cylinder 710 of the present embodiment is made only of polyethylene terephthalate (PET) if disregarding impurities mixed during the manufacturing process.

The fire extinguisher cylinder 710 according to the present embodiment has a whole light transmittance from 5% to 75%. In a case where the whole light transmittance exceeds 75% in the fire extinguisher cylinder 710 of the present embodiment, similarly to the fire extinguisher cylinder 610 of the sixth embodiment, a fire extinguishant contained in the cylinder and adhering to the wall surface of the cylinder looks like dirt on the fire extinguisher, thereby causing deterioration in visual quality of the place around the installed fire extinguisher 700. On the other hand, in a case where the whole light transmittance is less than 5%, the residual quantity of the fire extinguishant is hard to be checked in emergency, which deteriorates utility of the fire extinguisher. Accordingly, appropriate transparency kept in the above range achieves harmonization between utility and visual quality of the outer appearance. It is more preferable that the fire extinguisher cylinder 710 has a whole light transmittance from 20% to 70%. The whole light transmittance in this range realizes better harmonization with visual quality around the location of installation.

In the fire extinguisher cylinder 710 according to the present embodiment, the thickness (T3) of the body portion 793 is preferably from 1 mm to 5 mm. If the thickness of the resin is less than 1 mm, it may not be possible to achieve strength at a level (such as approximately 2.0 MPa) required to a fire extinguisher cylinder. On the other hand, if the thickness thereof is more than 5 mm, such a cylinder is not economically preferable and may not be possible to achieve transparency enough to visually recognize the fire extinguishant contained therein. In view of the above, the thickness (T3) of the body portion 793 is more preferably from 2 mm to 3 mm.

The fire extinguisher cylinder 710 made of polyethylene terephthalate (PET) can be manufactured by adopting one of the conventionally known resin molding methods such as stretch blow molding and melting molding. Among these, stretch blow molding is preferably adopted because the resultant cylinder is provided with no joint, is well shaped, and has an appropriate thickness. In the case of manufacturing the cylinder by stretch blow molding, it is preferable to obtain a product of 6 or more (most preferably 6.5) by multiplying the stretch factor in scalar quantity at the body portion 793 in the circumferential direction by the stretch factor in scalar quantity in the direction perpendicular to the circumferential direction. In this case, the preform of the fire extinguisher cylinder 710 preferably has a whole light transmittance from 5% to 75%. In addition, the preform of the fire extinguisher cylinder 10 preferably has a thickness from 5 mm to 15 mm (most preferably 10 mm) so that the thickness (T3) of the body portion 793 is from 1 mm to 5 mm in the final molded component.

Eighth Embodiment

A fire extinguisher 800 according to the present embodiment has a configuration same as that of the fire extinguisher 100 according to the first embodiment except a feature that a fire extinguisher cylinder 810 is included in place of the fire extinguisher cylinder 10 of the first embodiment. Accordingly, there will not be repeatedly provided the description same as that of the first embodiment.

The fire extinguisher cylinder 810 according to the present embodiment is made only of polyethylene naphthalate (PEN) if disregarding impurities mixed during the manufacturing process. Further, because the fire extinguisher cylinder 810 is manufactured by stretch blow molding, the resultant cylinder is provided with no joint, is well shaped, and has an appropriate thickness. The stretch blow molding method includes the stretching step, so that polymer chains of the resin are oriented substantially in one direction. Improved therefore are transparency, strength, and rigidity of the resin.

The fire extinguisher cylinder 810 according to the present embodiment is shaped to have a body portion 893 of a thickness (T3) of 1.8 mm±0.4 mm. The fire extinguisher cylinder 810 of such a thickness can realize pressure resistance at a level (such as approximately 2.0 MPa) required to a fire extinguisher cylinder, economic efficiency, and appropriate visibility for visual recognition of the contained fire extinguishant.

Measurements were made on crystallinities of the resin at the respective portions of the fire extinguisher cylinder 810 according to the present embodiment. By the measurements, the crystallinity of the resin at a mouth portion 891 was found to be substantially 0%, and the crystallinity of the resin at a shoulder portion 892 was from 13% to 23%. Further, the crystallinity of the resin at the body portion 893 was from 14% to 27%, and the crystallinity of the resin at the bottom portion 894 was from 10% to 20%.

As described above, because the crystallinity of the resin at the body portion 893 is from 13% to 30% in the fire extinguisher cylinder 810, strength and pressure resistance of the fire extinguisher cylinder are improved by the crystallization of the resin, although the detailed mechanism has not yet been found out. Increase in crystallinity of the resin improves strength and/or pressure resistance of the cylinder 810, so that the cylinder 810 can achieve pressure resistance at a high level required to the fire extinguisher 800 even though the cylinder 810 is relatively thin. It is noted that, because such sufficient pressure resistance and strength have been secured already at this stage, there will be little necessity for the achievement of a crystallinity exceeding 30% of the resin at the body portion 893.

In the present embodiment, polyethylene naphthalate (PEN) as a material for the fire extinguisher cylinder 810 is firstly melted and this resin is injected or extruded into an injection molding die to obtain a preform having a thickness of approximately 15 mm±0.4 mm and a whole light transmittance of approximately 5%. The preform is then shaped into a final molded component so as to have a stretch factor at the body portion 893 in the circumferential direction being from 1.05 to 1.4 times a stretch factor thereat in the direction perpendicular to the circumferential direction, as well as to obtain a product from 12 to 13 by multiplying the stretch factor in the circumferential direction by the stretch factor in the direction perpendicular to the circumferential direction. These stretch factors secure pressure resistance required to a fire extinguisher cylinder.

In the present embodiment, the preform is 15 mm±0.4 mm thick and the thickness (T3) of the body portion 893 is 1.8 mm±0.4 mm in the fire extinguisher cylinder 810 as the final molded component. Alternatively, even in a case as in the fourth embodiment where the preform is 13 mm±0.4 mm thick and the thickness (T3) of the body portion 893 is 1.6 mm±0.4 mm in fire extinguisher cylinder 810 as the final molded component, there are partially exerted the effects of the present invention. Similarly, even in a case as in the fifth embodiment where the preform is 19 mm±0.4 mm thick and the thickness (T3) of the body portion 893 is 2.4 mm±0.4 mm in the fire extinguisher cylinder 810 as the final molded component, there are at least partially exerted the effects of the present invention.

Furthermore, the present embodiment adopts the fire extinguisher cylinder 810 made only of polyethylene naphthalate (PEN). Alternatively, even in a case as in the second embodiment where there is adopted the fire extinguisher cylinder made of polyethylene terephthalate (PET), there are at least partially exerted the effects of the present invention.

Ninth Embodiment

A fire extinguisher 900 according to the present embodiment has a configuration same as that of the fire extinguisher 100 according to the first embodiment except a feature that a fire extinguisher cylinder 910 is included in place of the fire extinguisher cylinder 10 of the first embodiment. Accordingly, there will not be repeatedly provided the description same as that of the first embodiment.

The fire extinguisher cylinder 910 according to the present embodiment has a whole light transmittance from 5% to 75%. In a case where the whole light transmittance exceeds 75% in the fire extinguisher cylinder 910 of the present embodiment, similarly to the sixth embodiment, the fire extinguishant contained in the cylinder and adhering to the wall surface of the cylinder looks like dirt on the fire extinguisher, thereby causing deterioration in visual quality of the place around the installed fire extinguisher 900. On the other hand, in a case where the whole light transmittance is less than 5%, the residual quantity of the fire extinguishant is hard to be checked in emergency, which deteriorates utility of the fire extinguisher. Accordingly, appropriate transparency kept in the above range achieves harmonization between utility and visual quality of the outer appearance. It is more preferable that the fire extinguisher cylinder 910 has a whole light transmittance from 20% to 70%. The whole light transmittance in this range realizes better harmonization with visual quality around the location of installation.

When the fire extinguisher cylinder 910 is manufactured by stretch blow molding, a preform of the fire extinguisher cylinder 910 preferably has a whole light transmittance from 5% to 75%. In a case where the whole light transmittance exceeds 75% in the preform of the fire extinguisher cylinder 910, the fire extinguishant contained in the fire extinguisher cylinder 910 having been processed by stretch blow molding and adhering to the wall surface thereof looks like dirt on the fire extinguisher, thereby causing deterioration in visual quality of the place around the installed fire extinguisher 900. On the other hand, in a case where the whole light transmittance of the preform is less than 5%, the residual quantity of the fire extinguishant contained in the fire extinguisher cylinder 910 having been processed by stretch blow molding is hard to be checked in emergency, which deteriorates utility of the fire extinguisher. Accordingly, also in the preform of the fire extinguisher cylinder 910, transparency kept in the above range achieves harmonization between utility and visual quality of the outer appearance of the fire extinguisher cylinder 910 having been processed by stretch blow molding.

It is preferable that the preform of the fire extinguisher cylinder 910 according to the present embodiment has a thickness from 4 mm to 30 mm. When the preform is shaped to satisfy the ranges specified above and to have a whole light transmittance from 5% to 75%, the fire extinguisher cylinder 910 having been processed by stretch blow molding secures transparency of a whole light transmittance from 20% to 70%, while obtaining a product of approximately 6.5 by multiplying the stretch factor in scalar quantity at the body portion 993 in the circumferential direction by the stretch factor in scalar quantity in the direction perpendicular to the circumferential direction.

Tenth Embodiment

A fire extinguisher 1000 according to the present embodiment has a configuration same as that of the fire extinguisher 200 according to the second embodiment except a feature that a fire extinguisher cylinder 1010 is included in place of the fire extinguisher cylinder 210 of the second embodiment. Accordingly, there will not be repeatedly provided the description same as that of the second embodiment.

The fire extinguisher cylinder 1010 according to the present embodiment has a whole light transmittance from 5% to 75%. In a case where the whole light transmittance exceeds 75% in the fire extinguisher cylinder 1010 of the present embodiment, similarly to the seventh embodiment, the fire extinguishant contained in the cylinder and adhering to the wall surface of the cylinder looks like dirt on the fire extinguisher, thereby causing deterioration in visual quality of the place around the installed fire extinguisher 1000. On the other hand, in a case where the whole light transmittance is less than 5%, the residual quantity of the fire extinguishant is hard to be checked in emergency, which deteriorates utility of the fire extinguisher. Accordingly, appropriate transparency kept in the above range achieves harmonization between utility and visual quality of the outer appearance. It is more preferable that the fire extinguisher cylinder 1010 has a whole light transmittance from 20% to 70%. The whole light transmittance in this range realizes better harmonization with visual quality around the location of installation.

It is preferable that the preform of the fire extinguisher cylinder 1010 according to the present embodiment has a thickness from 5 mm to 15 mm. When the preform is shaped to satisfy the ranges specified above and to have a whole light transmittance from 20% to 70%, the fire extinguisher cylinder 1010 having been processed by stretch blow molding secures transparency of a whole light transmittance from 20% to 70%, while obtaining a product of approximately 6.5 by multiplying the stretch factor in scalar quantity at the body portion 1093 in the circumferential direction by the stretch factor in scalar quantity in the direction perpendicular to the circumferential direction.

Eleventh Embodiment

A fire extinguisher 1100 according to the present embodiment has a configuration same as that of the fire extinguisher 300 according to the third embodiment except a feature that a fire extinguisher cylinder 1110 is included in place of the fire extinguisher cylinder 310 of the third embodiment. Accordingly, there will not be repeatedly provided the description same as that of the third embodiment.

The fire extinguisher cylinder 1110 according to the present embodiment has a whole light transmittance from 5% to 75%. In a case where the whole light transmittance exceeds 75% in the fire extinguisher cylinder 1110 of the present embodiment, similarly to the sixth embodiment, the fire extinguishant contained in the cylinder and adhering to the wall surface of the cylinder looks like dirt on the fire extinguisher, thereby causing deterioration in visual quality of the place around the installed fire extinguisher 1100. On the other hand, in a case where the whole light transmittance is less than 5%, the residual quantity of the fire extinguishant is hard to be checked in emergency, which deteriorates utility of the fire extinguisher. Accordingly, appropriate transparency kept in the above range achieves harmonization between utility and visual quality of the outer appearance. It is more preferable that the fire extinguisher cylinder 1110 has a whole light transmittance from 20% to 70%. The whole light transmittance in this range realizes better harmonization with visual quality around the location of installation.

The preform of the fire extinguisher cylinder 1110 preferably has a whole light transmittance from 5% to 75%. In a case where the whole light transmittance exceeds 75% in the preform of the fire extinguisher cylinder 1110, the fire extinguishant contained in the fire extinguisher cylinder 1110 having been processed by stretch blow molding and adhering to the wall surface thereof looks like dirt on the fire extinguisher, thereby causing deterioration in visual quality of the place around the installed fire extinguisher 900. On the other hand, in a case where the whole light transmittance of the preform is less than 5%, the residual quantity of the fire extinguishant contained in the fire extinguisher cylinder 1110 having been processed by stretch blow molding is hard to be checked in emergency, which deteriorates utility of the fire extinguisher. Accordingly, also in the preform of the fire extinguisher cylinder 1110, transparency kept in the above range achieves harmonization between utility and visual quality of the outer appearance of the fire extinguisher cylinder 1110 having been processed by stretch blow molding.

The preform of the fire extinguisher cylinder 1110 according to the present embodiment has a thickness of 15 mm±0.4 mm. Meanwhile, the preform of the fire extinguisher cylinder 1110 according to the present embodiment has a whole light transmittance of approximately 5%. Moreover, the final molded component is formed to have a stretch factor at a body portion 1193 in the circumferential direction being from 1.05 to 1.4 times a stretch factor thereat in the direction perpendicular to the circumferential direction, as well as to obtain a product from 12 to 13 by multiplying the stretch factor in the circumferential direction by the stretch factor in the direction perpendicular to the circumferential direction. These stretch factors secure pressure resistance required to a fire extinguisher cylinder.

In the present embodiment, the preform has a thickness of 15 mm±0.4 mm and the fire extinguisher cylinder 1110 as the final molded component includes the body portion 1193 having a thickness (T3) of 1.8 mm±0.4 mm. Alternatively, even in a case as in the fourth embodiment where the preform is 13 mm±0.4 mm thick and the thickness (T3) of the body portion 1193 is 1.6 mm±0.4 mm in the fire extinguisher cylinder 1110 as the final molded component, there are partially exerted the effects of the present invention. Similarly, even in a case as in the fifth embodiment where the preform is 19 mm±0.4 mm thick and the thickness (T3) of the body portion 1193 is 2.4 mm±0.4 mm in the fire extinguisher cylinder 1110 as the final molded component, there are at least partially exerted the effects of the present invention.

Furthermore, the present embodiment adopts the fire extinguisher cylinder 1110 made only of polyethylene naphthalate (PEN). Alternatively, even in a case as in the seventh embodiment where there is adopted the fire extinguisher cylinder made of polyethylene terephthalate (PET), there are at least partially exerted the effects of the present invention.

Twelfth Embodiment

A fire extinguisher 1200 according to the present embodiment has a configuration same as that of the fire extinguisher 800 according to the eighth embodiment except a feature that a fire extinguisher cylinder 1210 is included in place of the fire extinguisher cylinder 810 of the eighth embodiment. Accordingly, there will not be repeatedly provided the description same as that of the eighth embodiment.

The fire extinguisher cylinder 1210 according to the present embodiment has a whole light transmittance from 5% to 75%. In a case where the whole light transmittance exceeds 75% in the fire extinguisher cylinder 1210 of the present embodiment, similarly to the sixth embodiment, the fire extinguishant contained in the cylinder and adhering to the wall surface of the cylinder looks like dirt on the fire extinguisher, thereby causing deterioration in visual quality of the place around the installed fire extinguisher 1200. On the other hand, in a case where the whole light transmittance is less than 5%, the residual quantity of the fire extinguishant is hard to be checked in emergency, which deteriorates utility of the fire extinguisher. Accordingly, appropriate transparency kept in the above range achieves harmonization between utility and visual quality of the outer appearance. It is more preferable that the fire extinguisher cylinder 1210 has a whole light transmittance from 20% to 70%. The whole light transmittance in this range realizes better harmonization with visual quality around the location of installation.

The preform of the fire extinguisher cylinder 1210 preferably has a whole light transmittance from 5% to 75%. In a case where the whole light transmittance exceeds 75% in the preform of the fire extinguisher cylinder 1210, the fire extinguishant contained in the fire extinguisher cylinder 1210 having been processed by stretch blow molding and adhering to the wall surface thereof looks like dirt on the fire extinguisher, thereby causing deterioration in visual quality of the place around the installed fire extinguisher 1200. On the other hand, in a case where the whole light transmittance of the preform is less than 5%, the residual quantity of the fire extinguishant contained in the fire extinguisher cylinder 1210 having been processed by stretch blow molding is hard to be checked in emergency, which deteriorates utility of the fire extinguisher. Accordingly, also in the preform of the fire extinguisher cylinder 1210, transparency kept in the above range achieves harmonization between utility and visual quality of the outer appearance of the fire extinguisher cylinder 1210 having been processed by stretch blow molding.

In the present embodiment, the preform has a thickness of 15 mm±0.4 mm and the fire extinguisher cylinder 1210 as the final molded component includes a body portion 1293 having a thickness (T3) of 1.8 mm±0.4 mm. Alternatively, even in a case as in the fourth embodiment where the preform is 13 mm±0.4 mm thick and the thickness (T3) of the body portion 1293 is 1.6 mm±0.4 mm in the fire extinguisher cylinder 1210 as the final molded component, there are partially exerted the effects of the present invention. Similarly, even in a case as in the fifth embodiment where the preform is 19 mm±0.4 mm thick and the thickness (T3) of the body portion 1293 is 2.4 mm±0.4 mm in the fire extinguisher cylinder 1210 as the final molded component, there are at least partially exerted the effects of the present invention.

Furthermore, the present embodiment adopts the fire extinguisher cylinder 1210 made only of polyethylene naphthalate (PEN). Alternatively, even in a case as in the seventh embodiment where there is adopted the fire extinguisher cylinder made of polyethylene terephthalate (PET), there are at least partially exerted the effects of the present invention.

EXAMPLES

Table 22 indicates results of measurement tests on pressure resistance values of the fire extinguisher cylinders of the fire extinguishers manufactured in accordance with the first and second embodiments. In these tests, there was adopted a nitrogen gas tank as a pressure source, and air pressure resistance values were measured with use of a pressure regulator (model YR-5062) manufactured by YAMATOSANGYO CO., LTD. and a pressure gauge (model S41 or GLT41) manufactured by MIGISHITA SEIKI MFG. CO., LTD. The actual measurements were made by adopting a method of checking whether or not fire extinguisher cylinders were affected in a state where gas (nitrogen gas) supplied from the pressure source was kept to have a constant pressure with use of the pressure gauge. Also, in comparative examples, measurements were made on a commercial beer bottle made of polyethylene naphthalate (PEN) (Comparative Example 1) and a commercial soft drink bottle made of polyethylene terephthalate (PET) (Comparative Example 2) in the same method as in the first and second embodiments.

TABLE 22

| Type of Container | Classification of Pressurization Air Pressure (MPa) |
|---|---|
| First Embodiment: made of polyethylene naphthalate (PEN) | 3.5 |
| Second Embodiment: made of polyethylene terephthalate (PET) | 2.7 |
| Comparative Example 1: Commercial Beer Bottle made of polyethylene naphthalate (PEN) | 1.8 |
| Comparative Example 2: Commercial Soft Drink Bottle made of polyethylene terephthalate (PET) | 1.4 |

*Numerical values indicate pressure resistance values.

As indicated in Table 22, the fire extinguisher cylinder made of polyethylene naphthalate (PEN) and the fire extinguisher cylinder made of polyethylene terephthalate (PET) according to the above embodiments are not cracked or broken by a pressure of at least 2.6 MPa. It is thus found that the fire extinguisher cylinders according to the first and second embodiments exert strength at a level much higher than that of the commercial resin bottles. It is noted that ductile breaking occurred to the commercial bottles while brittle breaking occurred to the fire extinguisher cylinders according to the first and second embodiments. There were also executed hydraulic pressure tests. More specifically, there was adopted a manual test pump (model T-300N) manufactured by KYOWA CO LTD as a hydraulic pressure source, and hydraulic pressure resistance values were measured with use of the pressure gauge (model S41 or GLT41) manufactured by MIGISHITA SEIKI MFG. CO., LTD. By these tests, what is found is that the fire extinguisher cylinder made of any one of the resins is not cracked or broken when a hydraulic pressure of 2.6 MPa is applied to the fire extinguisher cylinder. Particularly found is that the fire extinguisher cylinder made of polyethylene naphthalate (PEN) is not cracked or broken even with the application of a hydraulic pressure of 3.0 MPa.

In the respective embodiments described above, polyethylene naphthalate or polyethylene terephthalate is solely adopted as a resin constituting the fire extinguisher cylinder. However, the present invention is not limited to these cases. The effects of the present invention will be exerted at least partially even in a case where, for example, the fire extinguisher cylinder is made of a polyester resin that is obtained by polycondensation of a dicarboxylic acid component mainly including a naphthalenedicarboxylic acid or a terephthalic acid and a diol component mainly including ethylene glycol or butanediol, or the fire extinguisher cylinder is made of a material mainly including any one of the above polyester resins. In other words, the effects of the present invention will be at least partially exerted with use of a copolymerized polyester resin.

Other examples of possible materials include polyolefin such as polyethylene or polypropylene, polyphenylene sulfide, polystyrene, and polycarbonate. However, in view of strength, polyethylene terephthalate (PET) or polyethylene naphthalate (PEN) is preferably adopted among all the materials exemplified above. In order to improve transparency, it is preferable to solely adopt polyethylene naphthalate (PEN) or adopt blended materials including polyethylene naphthalate (PEN) as a main material and polyethylene terephthalate (PET) as a sub material. Furthermore, in view of transparency, strength, and gas barrier properties, it is most preferable to solely adopt polyethylene naphthalate (PEN). Accordingly, adoption of polyethylene naphthalate (PEN) further increases the possibility of realization of the fire extinguisher cylinder having strength at a high level while keeping appropriate transparency.

There is no particular limitation to the type of the fire extinguishant that is filled in the fire extinguisher cylinder of the fire extinguisher according to each of the embodiments described above. It is possible to adopt any known fire extinguishant as long as it does not affect the resin constituting the fire extinguisher cylinder. For example, a powdery fire extinguishant can be adopted to the fire extinguisher of the present invention. Further, it is possible to appropriately adopt any one of the methods of filling the fire extinguishant as well as the materials and shapes of the components such as a hose and a nozzle, as long as they have been conventionally proposed.

The fire extinguishant can be released by pressurization or accumulation. It is particularly notable that each of the above embodiments describes the fire extinguisher of the accumulation type, which is capable of containing a fire extinguishant of high pressure at a level equal to or higher than that contained in a conventional fire extinguisher. Further, the resin constituting the fire extinguisher cylinder may be appropriately blended with any one of known additives such as a light stabilizer, an ultraviolet absorber, and an antioxidant, for the purposes of preventing discoloration and improving weather resistance.

In the fire extinguisher cylinder according to one of the third to fifth, eighth, eleventh, and twelfth embodiments described above, the preform has a thickness of 13 mm±0.4 mm, 15 mm±0.4 mm, or 19 mm±0.4 mm at the site corresponding to the body portion 393, 493, 593, 893, 1193, or 1293 of the final molded component. However, the present invention is not limited to the above cases. It will be occasionally possible to achieve excellent pressure resistance as in each of the above embodiments even in a case where the preform has a thickness less than 13 mm±0.4 mm or more than 19 mm±0.4 mm at the site corresponding to the body portion 393, 493, 593, 893, 1193, or 1293 of the final molded component. Moreover, it will be occasionally possible to achieve excellent pressure resistance as in each of the above embodiments even in a case where the thickness (T3) of the body portion 393, 493, 593, 893, 1193, or 1293 is less than 1.2 mm or more than 2.8 mm in the final molded component. For example, excellent pressure resistance will be obtained by adoption of the fire extinguisher cylinder inclusive of the body portion 393, 493, 593, 893, 1193, or 1293 that has the stretch factor in the circumferential direction being from 1.05 to 1.4 times the stretch factor in the direction perpendicular to the circumferential direction as well as obtains a product from 12 to 13 by multiplying the stretch factor in the circumferential direction by the stretch factor in the direction perpendicular to the circumferential direction. More excellent pressure resistance will be obtained by adoption of the fire extinguisher cylinder inclusive of the body portion 393, 493, 593, 893, 1193, or 1293 that has the stretch factor in the circumferential direction being from 1.1 to 1.2 times the stretch factor in the direction perpendicular to the circumferential direction as well as obtains a product from 12.1 to 12.3 by multiplying the stretch factor in the circumferential direction by the stretch factor in the direction perpendicular to the circumferential direction. Nevertheless, in view of reduction in quantity of the material for the environment, reduction in molding period and cooling period (manufacturing cost), and facilitation of molding, the preform preferably has a thickness from 13 mm±0.4 mm to 15 mm±0.4 mm at the site corresponding to the body portion 393, 493, 593, 893, 1193, or 1293 of the final molded component.

As having been described, also included in the claims of the present invention are modifications that are made within the scope of the present invention as well as other combinations of the respective embodiments.

INDUSTRIAL APPLICABILITY

A fire extinguisher according to the present invention adopts a fire extinguisher cylinder made of a resin, and is therefore significantly useful in the industry of fire extinguishers.

DESCRIPTION OF SYMBOLS

| | |
|---|---|
| 10, 210, 310, 410, 510, 610, 710, 810, 910, 1010, 1110, 1210 | fire extinguisher cylinder |
| 11 | fire extinguisher storage portion |
| 12 | male thread portion |
| 30 | fire extinguisher lever handle |
| 31 | cap |
| 32 | carry handle |
| 33 | top lever |
| 34 | safety pin socket |
| 35 | safety pin |
| 40 | fire extinguisher hose |
| 50 | support base |
| 60 | fire extinguishant |
| 70 | siphon tube |
| 91, 291, 691, 791, 891 | mouth portion |
| 92, 292, 692, 792, 892 | shoulder portion |
| 93, 293, 393, 493, 593, 693, 793, 893, 993, 1093, 1193, 1293 | body portion |
| 94, 294, 694, 794, 894 | bottom portion |
| 100, 200, 300, 400, 500, 600, 700, 800, 900, 1000, 1100, 1200 | fire extinguisher |

The invention claimed is:

1. A fire extinguisher comprising a fire extinguisher cylinder, wherein the fire extinguisher is an accumulation-type fire extinguisher, the fire extinguisher cylinder includes an opened mouth portion, a shoulder portion, a cylindrical body portion, and a bottom portion, the fire extinguisher cylinder comprises a resin and the fire extinguisher cylinder has no joint, the resin is polyethylene naphthalate, the fire extinguisher cylinder is shaped by stretch blow molding, and the body portion has a stretch factor in a circumferential direction being from 1.05 to 1.4 times a stretch factor at the body portion in a direction perpendicular to the circumferential direction, the body portion has a thickness from 1 mm to 5 mm, and a crystallinity of the resin is from 13% to 30% at sites other than the mouth portion and the bottom portion and the fire extinguisher cylinder is not cracked or broken when a hydraulic pressure of 2.6 MPa is applied thereto.

2. The fire extinguisher according to claim 1, wherein the fire extinguisher cylinder is shaped by stretch blow molding, and the body portion has a stretch factor in a circumferential direction being from 1.12 to 1.26 times a stretch factor at the body portion in a direction perpendicular to the circumferential direction.

3. The fire extinguisher according to claim 1, wherein the fire extinguisher cylinder comprises the resin having a visible light transmittance from 5% to 75%.

4. The fire extinguisher according to claim 2, wherein the fire extinguisher cylinder comprises the resin having a visible light transmittance from 5% to 75%.

5. The fire extinguisher according to claim 1, wherein the body portion has a thickness from 1 mm to 3 mm, and a crystallinity of the resin is from 14% to 27% at the body portion.

6. The fire extinguisher according to claim 1, wherein the body portion has a permanent strain rate of less than 1% after a hydraulic pressure of 3 MPa is applied to an inner portion of the fire extinguisher cylinder.

7. The fire extinguisher according to claim 1, wherein the body portion has a permanent strain rate of less than 0.8% after a hydraulic pressure of 3 MPa is applied to an inner portion of the fire extinguisher cylinder.

8. The fire extinguisher according to claim 2, wherein the body portion has a thickness from 1 mm to 3 mm, and a crystallinity of the resin is from 14% to 27% at the body portion.

9. The fire extinguisher according to claim 3, wherein the body portion has a thickness from 1 mm to 3 mm, and a crystallinity of the resin is from 14% to 27% at the body portion.

10. The fire extinguisher according to claim 4, wherein the body portion has a thickness from 1 mm to 3 mm, and a crystallinity of the resin is from 14% to 27% at the body portion.

11. The fire extinguisher according to claim 2, wherein the body portion has a permanent strain rate of less than 1% after a hydraulic pressure of 3 MPa is applied to an inner portion of the fire extinguisher cylinder.

12. The fire extinguisher according to claim 3, wherein the body portion has a permanent strain rate of less than 1% after a hydraulic pressure of 3 MPa is applied to an inner portion of the fire extinguisher cylinder.

13. The fire extinguisher according to claim 4, wherein the body portion has a permanent strain rate of less than 1% after a hydraulic pressure of 3 MPa is applied to an inner portion of the fire extinguisher cylinder.

14. The fire extinguisher according to claim 2, wherein the body portion has a permanent strain rate of less than 0.8% after a hydraulic pressure of 3 MPa is applied to an inner portion of the fire extinguisher cylinder.

15. The fire extinguisher according to claim 3, wherein the body portion has a permanent strain rate of less than 0.8% after a hydraulic pressure of 3 MPa is applied to an inner portion of the fire extinguisher cylinder.

16. The fire extinguisher according to claim 4, wherein the body portion has a permanent strain rate of less than 0.8% after a hydraulic pressure of 3 MPa is applied to an inner portion of the fire extinguisher cylinder.

* * * * *